US005560057A

United States Patent [19]

Madsen et al.

[11] Patent Number: 5,560,057

[45] Date of Patent: Oct. 1, 1996

[54] TURNING AIR MATTRESS

[76] Inventors: Roger T. Madsen, 14272 Acacia Dr., Tustin, Calif. 92680; Thomas H. Ludden, 25095 Owens Lake, Lake Forest, Calif. 92630

[21] Appl. No.: 269,557

[22] Filed: Jul. 1, 1994

[51] Int. Cl.[6] ..... A61G 7/04

[52] U.S. Cl. ..... 5/715; 5/710; 5/711; 5/713; 5/737

[58] Field of Search ..... 5/453, 455–457, 5/468, 469, 470, 499, 500, 914

[56] References Cited

U.S. PATENT DOCUMENTS

| | | | |
|---|---|---|---|
| 1,772,310 | 8/1930 | Hart . | |
| 2,649,595 | 8/1953 | Lewin . | |
| 2,769,182 | 11/1956 | Nunlist . | |
| 3,477,071 | 11/1969 | Emerson . | |
| 3,485,240 | 12/1969 | Fountain . | |
| 3,492,988 | 2/1970 | De Maré. | |
| 3,526,908 | 9/1970 | Davis . | |
| 3,775,781 | 12/1973 | Bruno et al. . | |
| 3,795,021 | 3/1974 | Moniot . | |
| 3,909,858 | 10/1975 | Ducker | 5/455 |
| 3,935,604 | 2/1976 | Collins . | |
| 4,197,837 | 4/1980 | Tringali et al. . | |
| 4,542,547 | 9/1985 | Sato . | |
| 4,634,179 | 1/1987 | Hashimoto et al. . | |
| 4,642,825 | 2/1987 | Kurita . | |
| 4,654,903 | 4/1987 | Chubb et al. . | |
| 4,694,520 | 9/1987 | Paul et al. . | |
| 4,722,105 | 2/1988 | Douglas . | |
| 4,768,249 | 9/1988 | Goodwin . | |
| 4,833,614 | 5/1989 | Saitoh et al. . | |
| 4,864,671 | 9/1989 | Evans . | |
| 4,949,412 | 8/1990 | Goode . | |
| 4,949,414 | 8/1990 | Thomas et al. . | |
| 4,953,247 | 9/1990 | Hasty . | |
| 4,982,466 | 1/1991 | Higgins et al. . | |
| 4,986,738 | 1/1991 | Kawasaki et al. . | |
| 4,989,283 | 2/1991 | Krouskop . | |
| 4,999,867 | 3/1991 | Toivio et al. . | |
| 5,003,654 | 4/1991 | Vrzalik . | |
| 5,005,240 | 4/1991 | Vrzalik . | |
| 5,008,965 | 4/1991 | Vrzalik . | |
| 5,020,176 | 6/1991 | Dotson . | |
| 5,044,029 | 9/1991 | Vrzalik . | |
| 5,090,077 | 2/1992 | Caden et al. . | |
| 5,092,007 | 3/1992 | Hasty | 5/453 |
| 5,095,568 | 3/1992 | Thomas et al. . | |
| 5,103,519 | 4/1992 | Hasty . | |
| 5,109,561 | 5/1992 | Schild | 5/453 |
| 5,121,512 | 6/1992 | Kaufmann . | |
| 5,129,115 | 7/1992 | Higgins et al. . | |
| 5,142,719 | 9/1992 | Vrzalik . | |
| 5,235,713 | 8/1993 | Guthrie et al. . | |
| 5,323,500 | 6/1994 | Roe et al. | 5/455 X |
| 5,357,641 | 10/1994 | Schubert . | |
| 5,375,273 | 12/1994 | Bodine, Jr. et al. | 5/455 |

FOREIGN PATENT DOCUMENTS

| | | |
|---|---|---|
| 1545806 | 5/1979 | United Kingdom . |
| 1601682 | 11/1981 | United Kingdom . |

OTHER PUBLICATIONS

Lumex Div. Of Lumex, Inc., "Dermatek 4000 User Manual," Brochure, 1991.

RT2000 Continuous Aerial Rotation System Brochure SCD Industries, Carrollton, Texas.

Microair® Turn–Q™ Turning Mattress Brochure microAir by Invacare, Carmel, New York.

*Primary Examiner*—Michael F. Trettel

[57] ABSTRACT

A turning air mattress serving to facilitate the therapeutic benefits of turning a bed ridden patient includes a combination of elongated transverse and longitudinal air cells disposed on a base and encompassed by a cell liner. The air cells are attached to a plurality of cell manifolds in communication with a control system. A top cover covering the air cells is attached to the base, and a fleece and top sheet are fittedly retained over the air cells.

The control system having a microprocessor monitors the pressure within the air cells, along with overall system functions. The control system also enables a patient to be rotated from side to side, and leveled after being turned, in a smooth transition from a level position to a turned position, or from a turned position to a level position, while substantially maintaining spinal alignment.

27 Claims, 35 Drawing Sheets

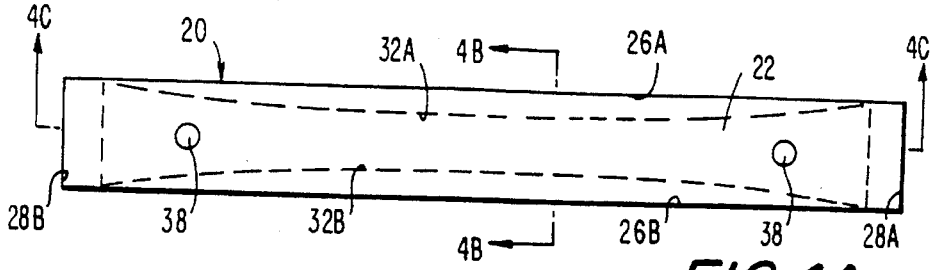
FIG.4A
FIG.4B
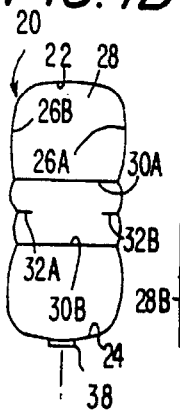
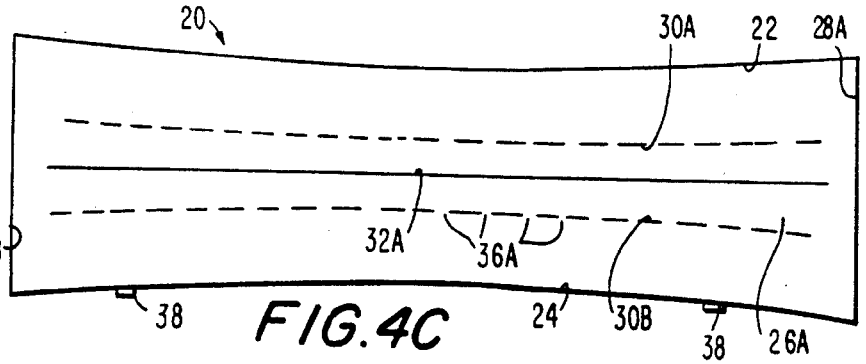
FIG.4C
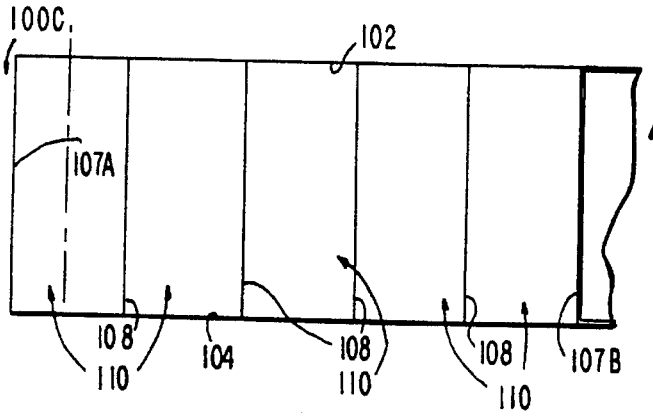
FIG.4D
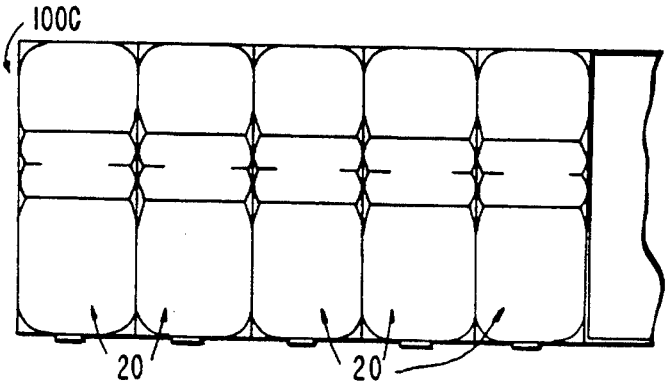
FIG. 4E 48B
44B
44A
60
69
70A
63B
63A
70B
68A
67A
68B
67B
66A
72A
66B
62B
62A
71A
72B
65
77
71B
74
76B
75
73
61
64
38
96B
48A
94
96A
98A
97
98B
95
38
46B
50
42
54A
58A
54B
58B
56
52
38
83B
87A
83A
88B
89
88A
80
86A
46A
87B
85A
86B
91A
82A
85B
84
90A
82B
93
91B
81
90B
92
38
102
100A
106B
106A
124B
104
122B
116B
118B
112B
114
112A
118A
116A
122A
120A
124

134A
140
148

134B
142
146
134A
148
144A
130
148
142
146
148
146
142
148
142
148
138B
136A
140
135
148
136B
138A
144
148
250
148
132A
132B
148
138A
146
142

20/40
38
148
130

TURNING AIR MATTRESS

FIELD OF THE INVENTION

This invention relates to air support beds and, more particularly, to an air support mattress that facilitates the therapeutic benefits of turning a patient.

BACKGROUND OF THE INVENTION

Many patients are confined to a bed for extended periods of time for a variety of reasons. Lengthy bed stays, especially where the patient is elderly, unable to or too weak to move, or simply lethargic, can cause additional complications that could be as serious or more threatening than the underlying ailment requiring the bed rest.

Bed sores and decubitus ulcers are some of the common problems that arise for bedridden individuals. During a lengthy stay in bed, the weight of various body parts tend to press the tissue against the bed mattress at a pressure exceeding the capillary occlusion pressure in that area. As a result, there is a significant reduction of blood flow through the tissue which, in areas of bony prominence such as the heel and hip, can result in the development of deep penetrating ulcers.

Another common problem for bedridden individuals is the accumulation of pulmonary fluids in a patient's lungs, especially for those suffering from trauma such as surgery. As a result, the patient is more susceptible to respiratory illnesses, such as pneumonia.

A further common problem for bedridden individuals is the lack of proper stimulation of a patient's kidneys and lymphatic system. The kidneys and lymphatic system are normally stimulated by the movement of the patient's large muscles, such as the leg or arm muscles. The lack of patient activity allows toxins and excess body fluids to build up which, in turn, slows the healing process.

However, it has been found that turning bedridden patients has many therapeutic benefits that combat the occurrence of such complications in patients. Turning a patient to different positions serves to reduce the interface pressure on a patient's skin over a large portion of the patient's body, and thus diminishes the likelihood that decubitus ulcers will develop. The turning action also serves to stimulate the patient's kidneys and lymphatic system, and thus diminishes the presence of toxins and fluids that tend to build up from a lack of patient activity. Additionally, the rotation of the patient's body aids the patient's lungs in eliminating the accumulation of pulmonary fluids, causing a "respiratory toilet" effect, and thus diminishing the likelihood of respiratory complications.

A number of different devices have been developed to accomplish patient turning with an air support mattress. All of these devices, however, utilize the basic underlying concept of inflating and deflating adjacent air cells or groups of air cells to accomplish patient turning. Some of the more common turning air mattress devices include the use of a group of full body length turning cells which are inflated and deflated in a specific sequence in order to turn a patient. Variations on this concept include longitudinal cells being used in combination with transverse cells and/or being overlaid on top of other air cells to prevent a patient from "bottoming out" during the turning process. Another device utilizes a matrix of small cells arranged to fully support the patient in which a combination of cells is inflated and deflated in specific order to turn the patient. A further device employs the use of air cells that have a cutaway design in alternating orientation between adjacent air cells, such that a cavity is formed for the patient to rotate into.

Notwithstanding the therapeutic benefits these turning mattresses may provide, they are not without shortcomings. These turning air mattresses do not necessarily ensure that the patient is in proper spinal alignment during the turning process. As a result, undue stress may be placed on the patient's spinal column which may cause the patient to experience severe discomfort and possibly spinal injury. Poor spinal alignment tends to be caused by the turning mattress's inability to properly adjust the leg and foot angle or maintain the leg and foot at a proper angle relative to the patient's torso during the turning operation, or the turning mattress's inability to restore a patient to the center position of the mattress surface after completing a turn to prevent or reduce a patient's tendency to drift to one side of the bed during the turning operation.

Therefore, it would be desirable to have a turning air mattress that is capable of reducing the stress on a patient's spinal column created during the turning process by having the ability to restore a patient to a center position on the mattress surface, to reduce the patient's tendency to drift during the turning operation, to properly adjust the angle or maintain a proper angle of a patient's leg and foot during the turning operation, and to generally maintain proper spinal alignment.

SUMMARY OF THE INVENTION

The turning air mattress of the present invention serves to facilitate the therapeutic benefits of turning a bed ridden patient by tending to reduce the stress on a patient's spinal column created during the turning process and by generally maintaining proper spinal alignment of a patient's spine.

According to an exemplary embodiment of the present invention, the turning air mattress is mounted on a bed frame and comprises a combination of elongated transverse and longitudinal air cells disposed on a base. The air cells are encompassed by a cell liner and attached to a plurality of cell manifolds in communication with a control system. In addition, a top cover is attached to the base and covers the air cells. Also a fleece and top sheet are fittedly retained over the air cells.

The transverse air cells preferably have a catenary shape along their top and bottom surfaces. The longitudinal air cells are preferably configured to include a fulcrum cell, inside right and left cells adjacent opposing sides of the fulcrum cell, outside right and left cells adjacent inside right and left cells, respectively, and right and left border cells adjacent right and left outside cells, respectively. This configuration serves to enable the turning air mattress to more efficiently and accurately achieve a patient turn angle, and more efficiently bring a patient out of a turn.

Preferably, the pressures within the air cells are controlled within six zones. The air cells are grouped in the six zones by interconnecting the air cells to the cell manifolds which distribute air to and exhaust air from the air cells. The cell manifolds are, in turn, interconnected to the control system of the turning air mattress.

The control system of the turning air mattress preferably comprises a microprocessor to monitor the pressure within the air cells, along with overall system functions. The control system also preferably comprises a valve box that includes inlet and exhaust valves, respectively, communicating with high pressure and exhaust plenums, respectively, and a plurality of manifold chambers. The manifold chambers distribute air to and from the respective cell zones. In addition, pressure sensors are preferably used to sense the pressure in each cell zone at the corresponding manifold chamber.

In operation, the microprocessor monitors the sensed pressure and opens ones of inlet and exhaust valves to adjust the pressure within the air cells to correspond to the different modes of operation, such as Float mode, Firm mode, or Turning mode.

In the Turning mode of operation, a patient is preferably turned to a desired angle of rotation, to either the patient's left or right, in a smooth transition from a center position to a turned position. The smooth transition is accomplished by successively achieving a series of target pressures in the longitudinal cells until the target pressures corresponding to the desired angle of rotation are achieved. Additionally, the pressures in the air cells in the foot/leg zone are adjusted serving to substantially maintain proper spinal alignment.

Before the patient is rotated in the opposite direction or taken out of the Turning mode of operation to enter the Float or Firm mode of operation, the patient is leveled and centered on the bed. The patient is leveled and centered by adjusting the pressures in low pressure longitudinal cells to a pressure tending to be greater than the fulcrum cell pressure and in high pressure longitudinal cells to a pressure tending to be less than the fulcrum cell pressure. The longitudinal cells are then pressurized to a maximum inflation level before returning to a center pressure profile. The transition from a turned position to a level position is accomplished in a similarly smooth fashion by successively achieving a series of target pressures in the longitudinal cells. The leveling process serves to maintain the patient in the center of the bed, above the fulcrum cell, thus serving to substantially maintain proper spinal alignment and increase turning efficiency.

A CPR mode of operation is also incorporated in the control system which closes all inlet valves and opens all exhausts valves. The operator can then pull a CPR strap connected to the cell manifolds to rapidly exhaust air from the air cells, thus tending to enable the operator to perform CPR on the flat surface of the base.

Accordingly, the primary object of the present invention is to provide an improved turning air mattress.

Another object of the present invention is to provide an improved turning air mattress that serves to maintain proper spinal alignment of the patient during the turning of a patient.

Further objects and advantages of this present invention will become apparent from a consideration of the drawings and ensuing description.

BRIEF DESCRIPTION OF THE DRAWINGS

FIG. 4A is a top view of a transverse air cell.

FIG. 4B is a cross-sectional view of the transverse air cell taken along a line 4B—4B in FIG. 4A.

FIG. 4C is a cross-sectional view of the transverse air cell taken along a line 4C—4C in FIG. 4A.

FIG. 4D is a partial cross-sectional view of a cell liner taken along line 4D—4D in FIG. 3B.

FIG. 4E is a partial cross-sectional view showing several transverse air cells of FIG. 4B, retained within a cell liner of FIG. 4D.

DESCRIPTION OF THE PREFERRED EMBODIMENT

Figure 1:
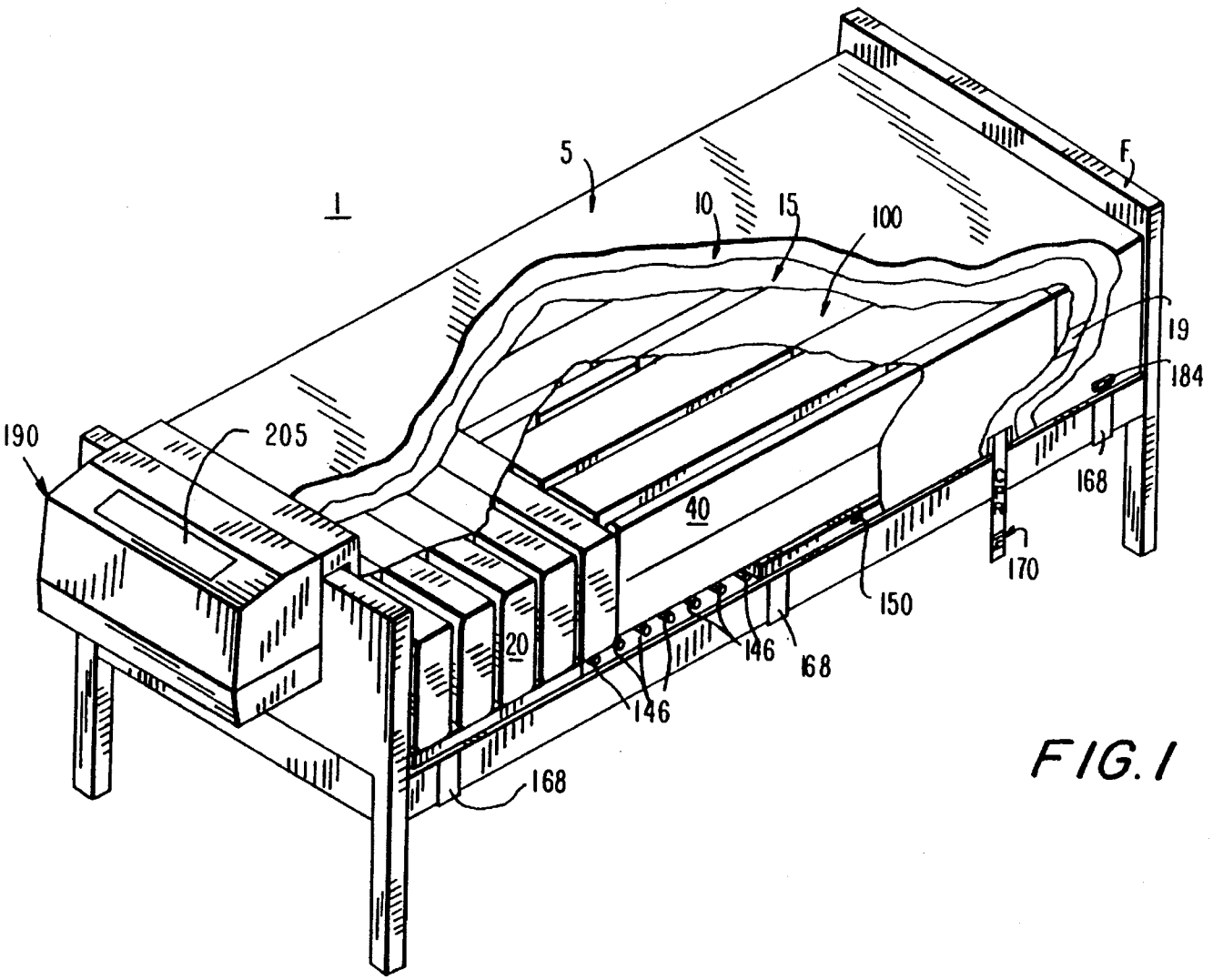
FIG. 1 is a perspective view with a partial cut-away of a preferred embodiment of the turning air mattress device of the present invention.
Figure 2:
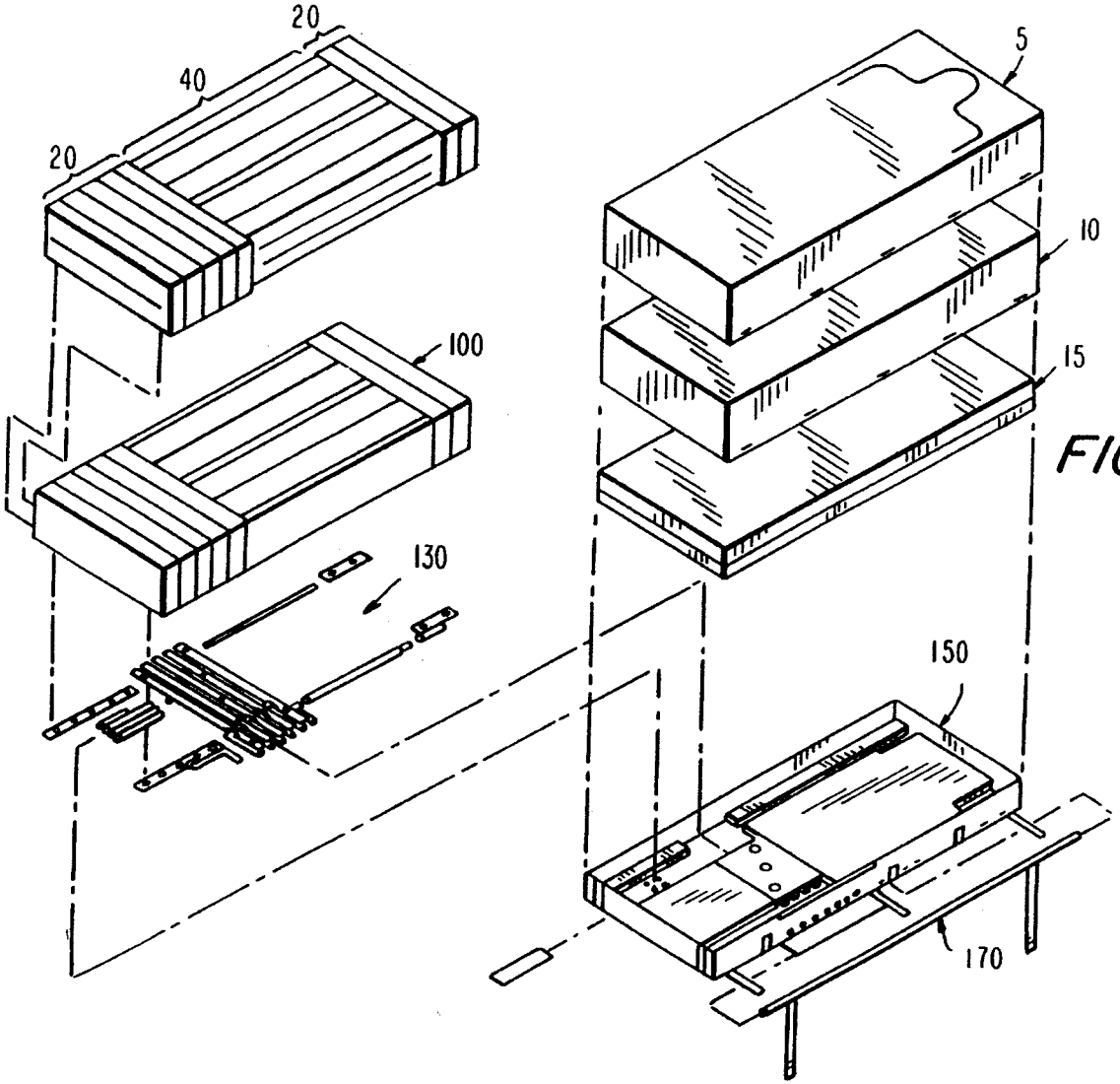
FIG. 2 is a partial exploded view of the turning air mattress device depicted in FIG. 1.

Referring now in detail to the drawings, therein illustrated is a preferred embodiment of a novel turning air mattress system of the present invention. Referring to FIGS. 1 and 2, the major components of the turning air mattress system 1 are shown comprising a control box 190, a plurality of air cells 20 and 40, a cell liner 100, a plurality of air distribution manifolds 130, a base 150, a top cover 15, a fleece 10, and a top aeration sheet 5. In brief, to be described in more detail below, the system 1 is assembled as follows, beginning with the base 150 and moving upward: the manifolds 130 are mounted on the base 150, the cells 20 and 40 are placed or positioned within the cell liner 100 and then connected to the manifolds 130, the top cover 15 is then placed over the assembly and attached to the base 150, and the fleece 10 and the top sheet 5 are then fitted over the top cover 15 and base 150. As shown in FIG. 1, the assembled system 1 is preferably mounted on a bed frame F with the base 150 of the system 1 preferably being fixedly attached to the frame F and the control box 190 of the system 1 preferably hanging off the frame F at the foot of the bed.

Figure 3A:
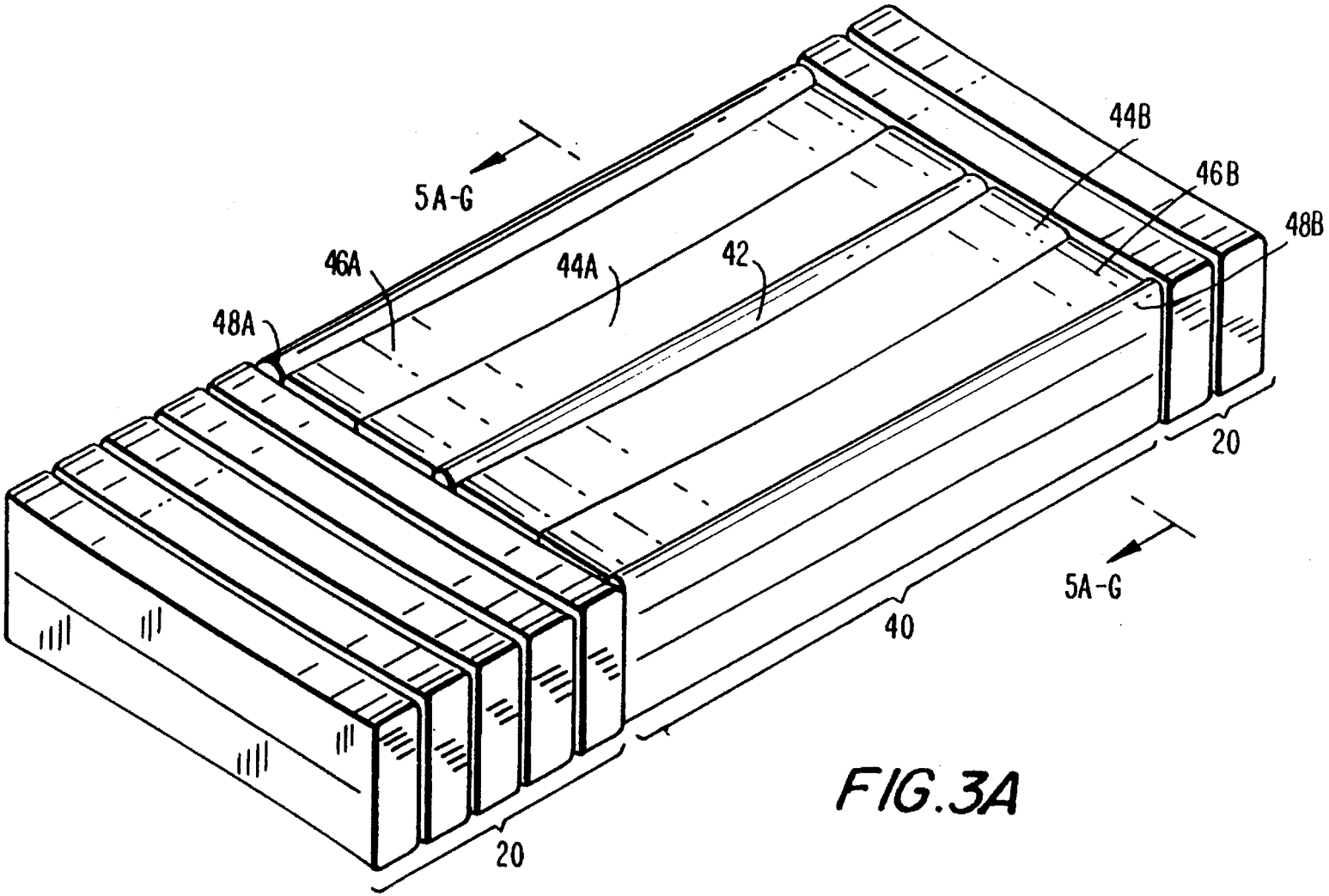
FIG. 3A is a perspective view of the air cells of FIGS. 1 and 2.

Referring now in further detail to each of the major components of the turning air mattress system 1, the air cells 20 and 40, as shown in FIGS. 2 and 3A, comprise a combination of transverse cells 20 and longitudinal, or turning, cells 40. This combination facilitates the efficient turning of a patient, while maximizing the patient's comfort and substantially ensuring the patient's positioning is anatomically correct during the turning process. It is preferred that the air cells 20 and 40 be used in groups or zones to control the air pressure within the air cells 20 and 40, ensuring that proper support is given to the different regions of a patient's body and that the patient is properly positioned while being turned. This embodiment of the present invention preferably utilizes a total of six pressure zones which will be described below with the air cells 20 and 40.

Each of the air cells 20 and 40 is preferably leak-tight, making them air and water impermeable. In a preferred construction of the air cells 20 and 40, each of the cells 20 and 40 is made from vinyl, allowing the air cells 20 and 40 to be flexible while remaining air and fluid impermeable. Thus, the air cells 20 and 40 are unlikely to capture infectious material from one patient and pass it onto another patient. In addition, the surface of the air cells 20 and 40 can easily be washed or cleaned to help maintain a non-infectious environment.

As shown in FIGS. 1, 2 and 3A, the transverse cells 20 are located in the head and foot/leg regions of the bed. The head region preferably comprises two transverse cells 20. The foot/leg region preferably comprises five transverse cells 20, two cells 20 for the foot region and three cells for the leg region.

Each of the transverse cells 20 is preferably the same size and is generally rectangular in cross-section, as shown in FIGS. 1, 3A, 4A–4C. The transverse cells 20 preferably span the width of a patient's bed. As shown in FIGS. 4A–4C, the transverse cells 20 generally have a pair of side walls 26A and 26B held in spaced arrangement by narrower top and bottom walls 22 and 24 respectively, and terminated by a pair of opposing end walls 28A and 28B. The walls 22, 24, 26A and 26B, and 28A and 28B are attached together along their edges. The preferable method of attachment includes adhesive or electronic bonding.

In the preferred construction, two horizontal interior walls 30A and 30B, as shown in FIG. 4C, are located equidistant from a midway point between the top and bottom walls 22 and 24 and attached to the side walls 26A and 26B, preferably by the methods noted above. The horizontal interior walls 30A and 30B are used to maintain the generally rectangular cross-section of the cells 20 and to diminish bowing of the side walls 26 when the cells 20 are inflated. The horizontal walls 30A and 30B include a series of apertures 36 therethrough to allow passage of air between chambers formed by the horizontal walls 30A and 30B and to balance the air pressure therebetween.

The transverse or lengthwise cross-section of the transverse cells 20, as shown in FIG. 4C, preferably has a substantially catenary-like or concave shape along the top and bottom walls 22 and 24. The transverse cross-section of the cells 20, as shown in FIG. 4C, is narrower at a midpoint between the end walls 28A and 28B than at a point nearer the end walls 28A and 28B. The shape of the cell 20 is accomplished by folding and pulling inwardly on the material of the side walls 26A and 26B to form darts 32A and 32B along the side walls' 26A and 26B transverse or lengthwise axis. The thickness of the darts 32A and 32B is the greatest at a midpoint between the end walls 28 and the least as the darts 32A and 32B approach the end walls 28A and 28B, as shown in FIGS. 4A.

The shape of the cells 20 serves to prevent the cells 20 from bulging or ballooning upward from the bed. If allowed to bulge or balloon upward from the bed, the cells 20 would cause the head, and/or feet and legs to ramp upward from the torso. This ramp effect would cause spinal misalignment during turning. The catenary shape, however, serves to limit outer spinal misalignment. In addition, the catenary shape serves to limit the motion of the patient's head during turning, thus diminishing the occurrence of motion sickness in the patient. Also, the catenary shape maintains the natural orientation of the head to the torso by preventing overturn of the patient's head. Without the catenary shape, the patient's face would tend to sink into the cells 20 due to the center of gravity of a patient's head being located toward the front of the patient's face.

As is further shown in FIGS. 4A–4C, the preferred cell 20 also includes two manifold connectors 38 bonded to the bottom wall 24. The manifold connectors 38 are preferably spaced apart equidistantly from a midpoint between the end walls 28.

The turning cells 40 preferably longitudinally span the torso region of the bed, as shown in FIGS. 1 and 3A. Referring to FIGS. 3A and 5A–G, the turning cells 40 preferably comprise a total of seven longitudinal cells 40 of the following configuration: a center fulcrum cell 42, inside right and left cells 44A and 44B, outside right and left cells 46A and 46B, and right and left border cells 48A and 48B. The inside right and left cells 44A and 44B are mirror images of one another and border the fulcrum cell 42 on its opposing sides. The right and left border cells 48A and 48B are identical and are located on opposing side edges of the bed to prevent the patient overturning or rolling off of the turning air mattress. The outside right and left cells 46A and 46B are also mirror images of one another and are interposed between the border cells 48A and 48B and the right and left inside cells 44A and 44B on opposing sides of the bed, respectively.

Figure 6:
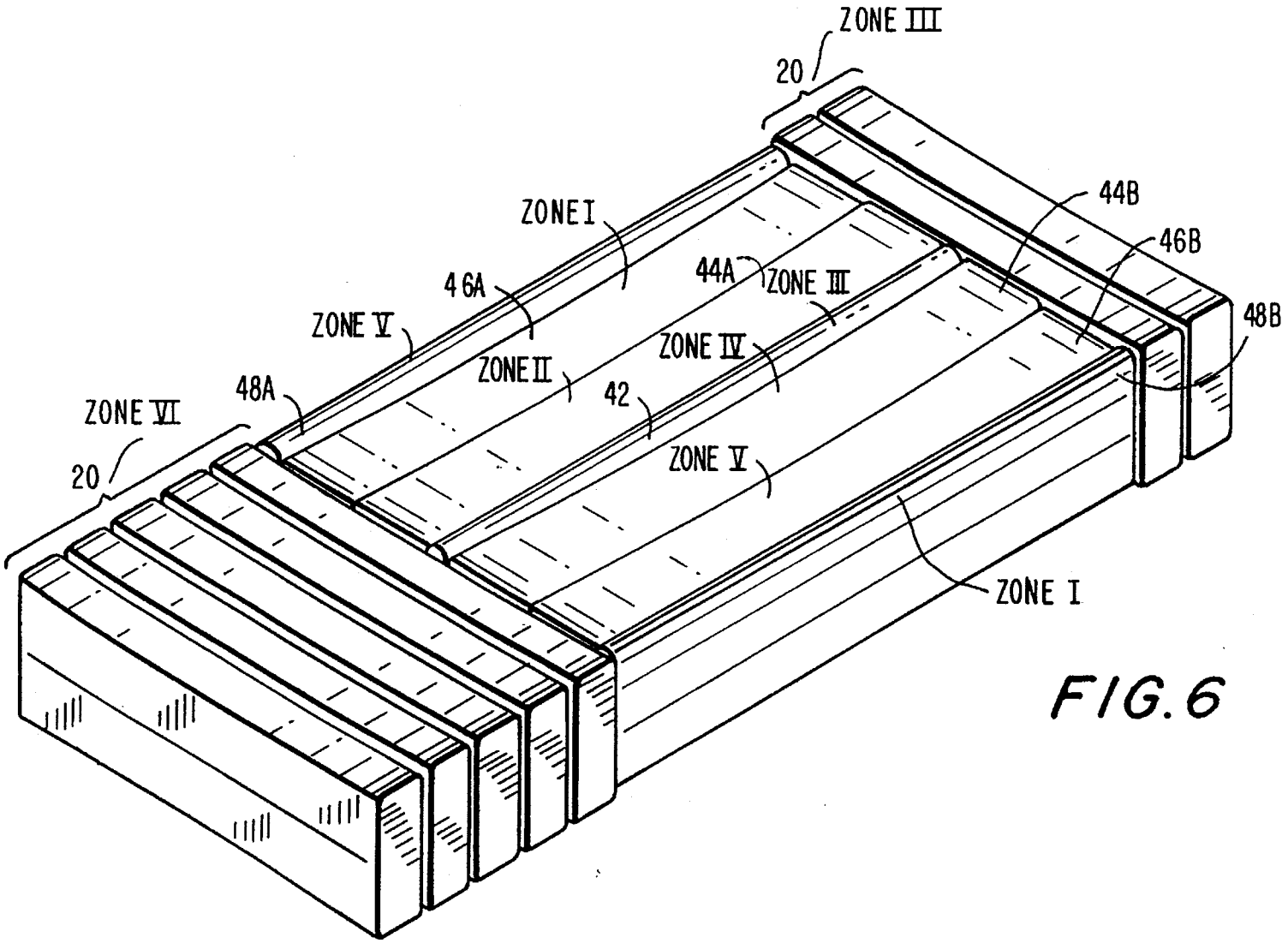
FIG. 6 is a perspective view of the pressure zones of the turning air mattress device of the present invention.

As noted above, the preferred embodiment of the present invention comprises six zones: Zones I–VI. However, other embodiments may comprise additional zones for greater control and more precise turning. As shown in FIG. 6, Zone III comprises the fulcrum cell 42 in combination with the transverse cells 20 of the head region. Other zones are configured as follows: Zone I comprises the outside right cell 46A and the left border cell 48B; Zone II comprises the inside right cell 44A; Zone IV comprises the inside left cell 44B; Zone V comprises the outside left cell 46B and the right border cell 48A; and Zone VI comprises the five transverse cells 20 of the foot/leg region of the bed.

Figure 3B:
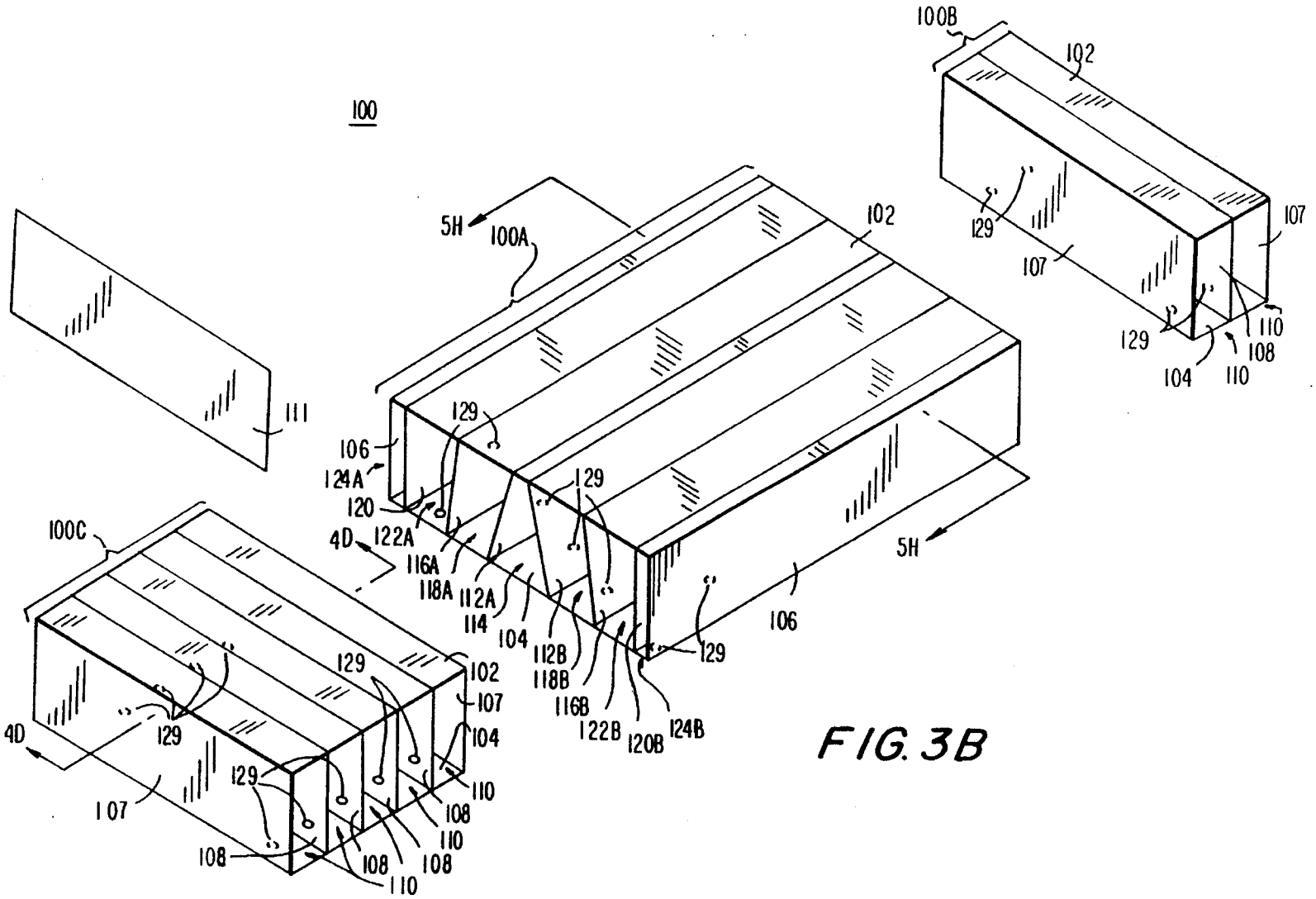
FIG. 3B is an exploded view of the cell liner of FIGS. 1 and 2.
Figures 5A, 5B, 5C, 5D, 5E, 5F, 5G, 5H:
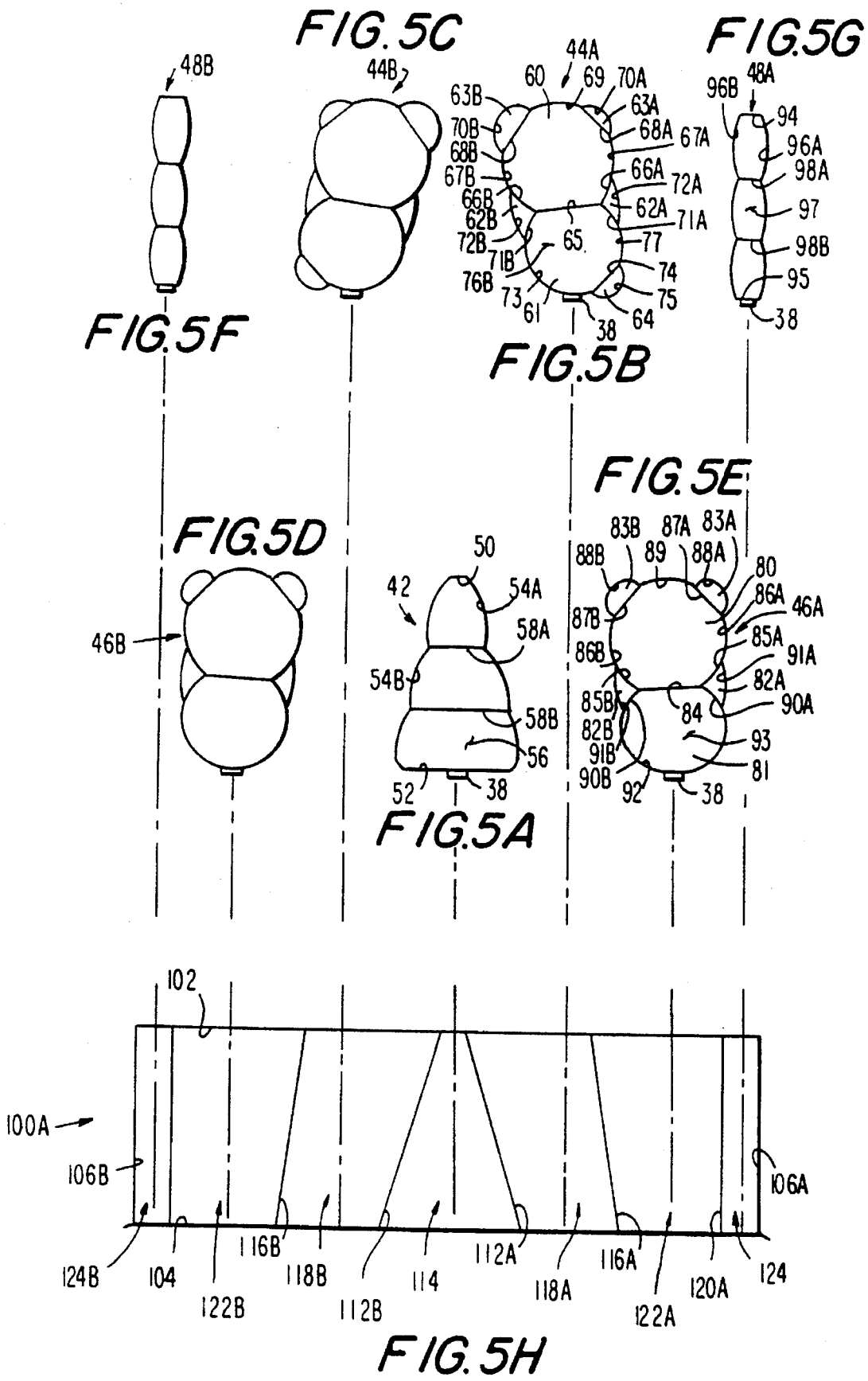
FIG. 5A is a cross-sectional view of a fulcrum air cell taken along a line 5A-G—5A-G in FIG. 3A.
FIG. 5B is a cross-sectional view of an inside right cell taken along a line 5A-G—5A-G in FIG. 3A.
FIG. 5C is a cross-sectional view of an inside left cell taken along a line 5A-G—5A-G in FIG. 3A.
FIG. 5D is a cross-sectional view of an outside left cell taken along a line 5A-G—5A-G in FIG. 3A.
FIG. 5E is a cross-sectional view of an outside right taken along a line 5A-G—5A-G in FIG. 3A.
FIG. 5F is a cross-sectional view of a left border cell taken along a line 5A-G—5A-G in FIG. 3A.
FIG. 5G is a cross-sectional view of a right border cell taken along a line 5A-G—5A-G in FIG. 3A.
FIG. 5H is a cross-sectional view of the cell liner taken along a line 5H—5H in FIG. 3B.
Figure 5I:
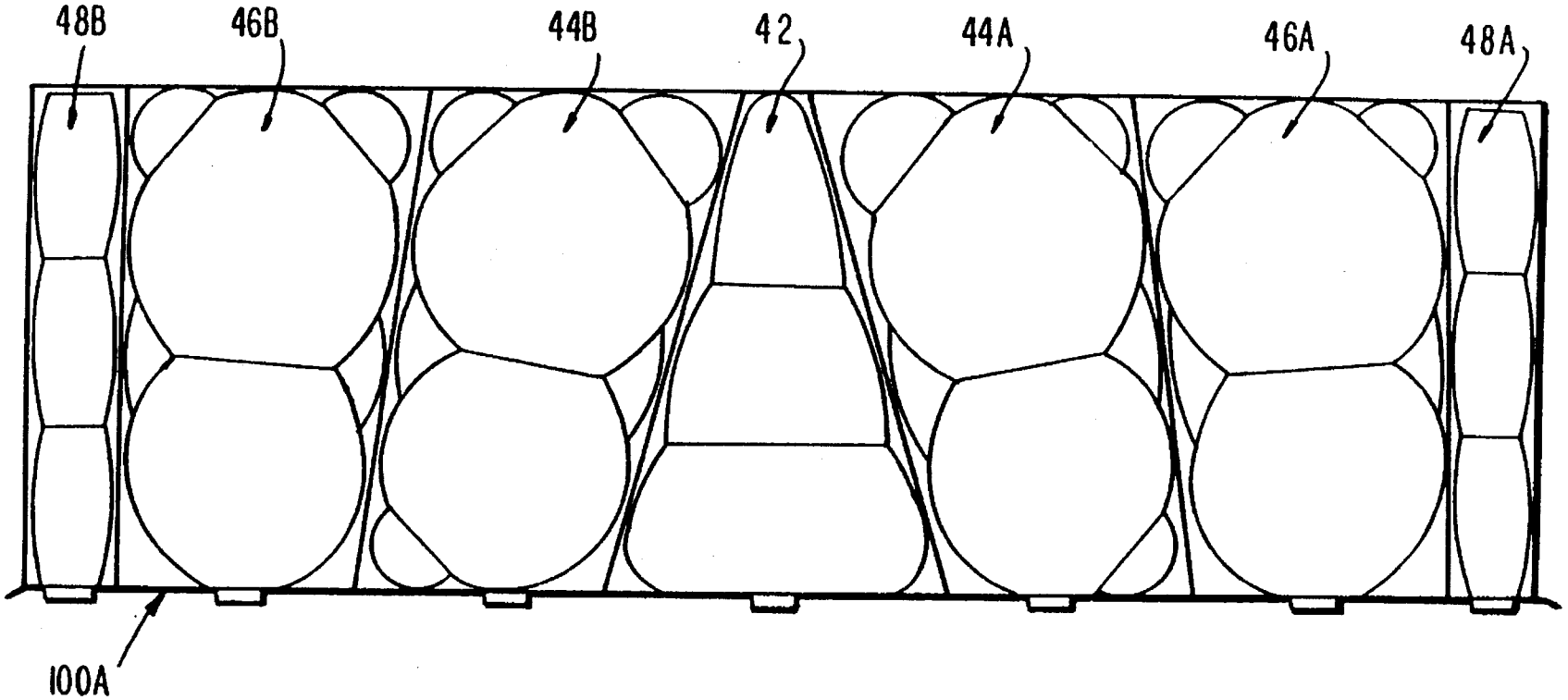
FIG. 5I is a cross-sectional view showing the turning cells of FIGS. 5A through 5G, retained within the cell liner FIG. 5H.

The cross-sectional configuration of the turning cells 42, 44A and 44B, 46A and 46B, and 48A and 48B are such that they adapt to a theoretical cross-sectional configuration. This theoretical cross-sectional configuration is illustrated by the configuration of the turning cell liner 100A for the turning cells 40 in the torso region of the bed. Referring to FIGS. 3B, 5H, and 5I, the turning cell liner 100A for the turning cells 40 has a top liner wall 102, a bottom liner wall 104, and two opposing vertical side liner walls 106A and 106B positioned perpendicular to the top and bottom walls 102 and 104. In addition, the cell liner 100A has internal boundaries defined by: two fulcrum walls 112A and 112B that incline upwardly and inwardly toward one another and which, along with the top and bottom walls 102 and 104, form a truncated triangular cross-sectional fulcrum cell receptacle 114 that is adapted to receive the fulcrum cell 42; two inner walls 116A and 116B that incline upwardly and inwardly toward one another and which, along with the top, bottom, and fulcrum walls 102, 104, 112A and 112B, form mirror image trapezoidal cross-sectional inside cell receptacles 118A and 118B on opposing sides of the fulcrum cell receptacle 114 that are adapted to receive the inside right and left cells 44A and 44B; and two border liner walls 120A and 120B which, along with the top, bottom and inner walls 102, 104, 116A and 116B, form mirror image trapezoidal cross-sectional outside cell receptacles 122A and 122B adjacent the inside cell receptacles 118A and 118B that are adapted to receive the outside right and left cells 46A and. 46B, and the border liner walls 120A and 120B also form, along with top, bottom, and side walls 102, 104, and 106A and 106B, two rectangular cross-sectional border cell receptacles 124A and 124B which are adapted to receive the right and left border cells 48A and 48B.

This cross-sectional configuration serves to enable the turning air mattress system 1 to more efficiently and accurately achieve a turn angle due to the slopes of the fulcrum and inside walls 112A, 112B, 116A and 116B, which the fulcrum cell 42, the right and left inside cells 44 and 44B, and outside left and right cells 46A and 46B adapt to. In addition, the turning air mattress system 1 is able to more efficiently bring a patient out of a turn due to an upward force vector (not shown) created by the trapezoidal cross-sections of the cells 44A and 44B and 46A and 46B as defined by the inside and outside cell receptacles 118A, 118B, 122A and 122B. The force vector tends to parallel the slope of the fulcrum and inside walls 112A, 112B, 116A and 116B, and be directed toward the center of the turning air mattress.

Figure 5K:
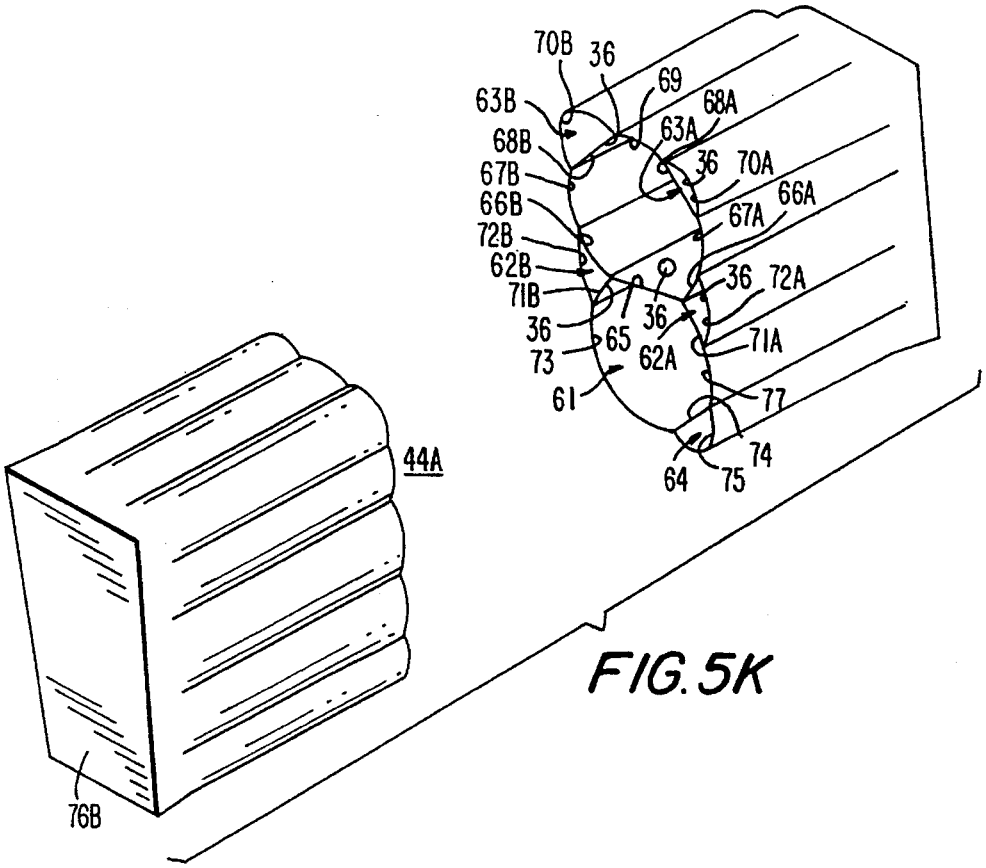
FIG. 5K is a partial perspective view of the side right cell.
Figure 5J:
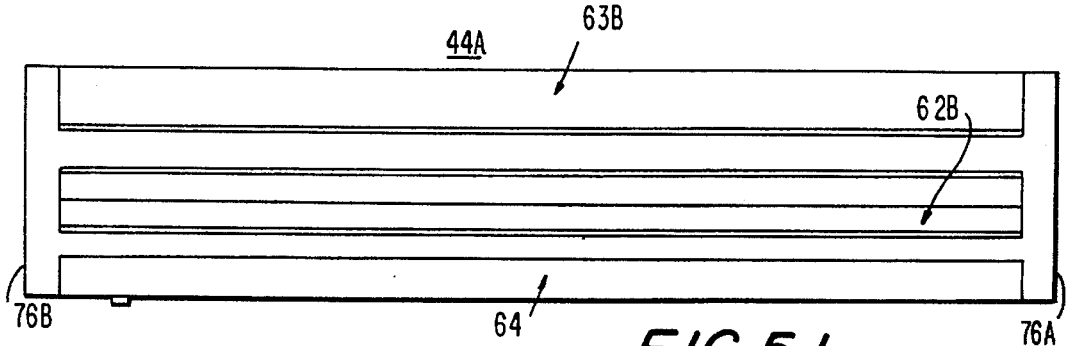
FIG. 5J is a side view of the inside right cell.

In a preferred embodiment of the turning cells 40, the fulcrum cell 42, as shown in FIG. 5A, comprises a top wall 50, a bottom wall 52, two opposing inclining side walls 54A and 54B, and two opposing end walls 56 (the end walls 56 are located similarly to the end walls 76A and 76B of FIGS. 5J and 5K); all of which are bonded together about their edges. The top, bottom, and side walls 50, 52, and 54A and 54B form a substantially truncated triangular cross-section. However, when fully inflated as shown in FIG. 5A, the walls 50, 52, 54A and 54B appear to be slightly arcuate. Therefore, internal horizontal walls 58A and 58B are provided approximately equidistant from a midpoint between the top and bottom walls 50 and 52 and bonded about their edges to the side walls 54A and 54B. The internal walls 58A and 58B are used to substantially maintain the preferred cross-sectional truncated triangular shape. The internal walls 58A and 58B include apertures (not shown, but like 36 of FIG. 4C), therethrough, to allow passage of air between chambers formed by the horizontal walls 58A and 58B and enable the balance of air pressure therebetween. In addition, the bottom wall 52 includes a manifold connector 38.

The inside right and left cells 44A and 44B, as noted above and as shown in FIGS. 5B and 5C, are mirror images of one another. The inside right and left cells 44A and 44B are shown to comprise a plurality of chambers with arcuate external walls. This unique combination of chambers, with arcuate external walls, enables the inside right and left cells 44A and 44B to substantially adapt to and maintain the theoretical trapezoidal cross-section of the inside cell receptacles 118A and 118B, as shown in FIG. 5I, even though the cells 44A and 44B are made from a flexible material such as vinyl.

Referring to FIG. 5B, the chambers of the inside right cell 44A comprise an upper main chamber 60, lower main chamber 61, two upper bulbous chambers 63A and 63B angularly extending outwardly and upwardly from the upper main chamber 60, two lateral chambers 62A and 62B extending laterally from the upper and lower main chambers 60 and 61, and a lower bulbous chamber 64 angularly extending outwardly and downwardly from the lower main chamber 61.

The upper main chamber 60 is substantially octagonal in cross-sectional shape, having a main baffle 65 acting generally as a horizontal base, two upper lateral baffles 66A and 66B angularly extending outwardly and upwardly from opposing ends of the main baffle 65, two arcuate upper side walls 67A and 67B extending upwardly from upper ends of the lateral baffles 66A and 66B, two upper bulbous baffles 68A and 68B angularly extending inwardly and upwardly from upper ends of the arcuate upper side walls 67A and 67B, and an arcuate top wall 69 extending between upper ends of the upper bulbous baffles 68A and 68B.

The upper bulbous chambers 63A and 63B are substantially semicircular in cross-sectional shape, with the upper bulbous chamber 63B being slightly larger than upper bulbous chamber 63A to enable the cell 44A to adapt to the slope of the trapezoidal cross-section of the upper end of the cell receptacle 118A. The chambers 63A and 63B are formed by upper bulbous arcuate walls 70A and 70B extending from one end of the upper bulbous baffles 68A and 68B, respectively, to the other end of the upper bulbous baffles 68A and 68B, respectively.

The lower main chamber 61 is similarly shaped to the upper main chamber 60 (i.e., approximately octagonal in cross-section) and shares the main baffle 65 with the upper main chamber 60 as a common baffle between the chambers. However, with the lower main chamber 61, the main baffle 65 generally acts as a horizontal ceiling. In addition, the lower main chamber comprises lower lateral baffles 71A and 71B angularly extending outwardly and downwardly from opposing ends of the main baffle 65, arcuate lower side walls 73 and 77 downwardly extending from lower ends of the lower lateral baffles 71A and 71B, and a lower bulbous baffle 74 angularly extending downwardly and inwardly from the lower end of the arcuate lower side wall 77 and to lower end of the arcuate lower side wall 73. The arcuate lower side wall 73 doubles as an arcuate bottom wall extending between the lower lateral baffle 71A and the lower bulbous baffle 74. In addition, the bottom wall portion of the lower side wall 73 includes a manifold connector 38.

The lower bulbous chamber 64 is substantially semicircular in cross-sectional shape, being formed by a lower bulbous arcuate wall 75 extending from one end of the lower bulbous baffle 74 to the other end of the lower bulbous baffle 74. The lower bulbous chamber 64 enables the cell 44A to adapt to the slope of the lower end of the trapezoidal cross-section of the cell receptacle 118A.

The lateral chambers 62A and 62B are substantially pie wedge shaped in cross-section (e.g., approximately triangular with three substantially arcuate sides), being formed by lateral arcuate walls 72A and 72B extending from the upper ends of the upper lateral baffles 66A and 66B to lower ends of the lower lateral baffles 71A and 71B.

Each of the baffles 65, 66A, 66B, 68A, 68B, 71A, 71B, and 74 include apertures 36 therethrough, as shown in FIG. 5K. The apertures allow passage of air between the various chambers to balance air pressure therebetween.

Preferably, the external walls 67A, 67B, 69, 70A, 70B, 72A, 72B, 73, 75, and 77 of the chambers 60, 61, 62A, 62B, 63A, 63B, and 64 are constructed out of a single sheet of vinyl having its two longitudinal edges bonded to one another. The bulbous chambers 63A, 63B, and 64 are formed by bonding opposing longitudinal edges of the bulbous baffles 68A, 68B, and 74 to the single sheet of vinyl. Preferably, the length of the single sheet of vinyl that is essentially trapped between the bonded edges of the baffles 68A, 68B, and 74 is greater than the width of each of the baffles 68A, 68B, and 74. As a result the baffles 68A, 68B, and 74 form chords to arcs, with the arcs being the bulbous arcuate walls 70A, 70B, and 75 of the bulbous chambers 63A, 63B, and 64, respectively.

The lateral chambers 62A and 62B are similarly constructed. Upper longitudinal edges of the upper lateral baffles 66A and 66B and lower longitudinal edges of the lower lateral baffles 71A and 71B are bonded to the single sheet of vinyl. Lower longitudinal edges of the upper lateral baffles 66A and 66B and upper longitudinal edges of the lower lateral baffles 71A and 71B are then bonded together to seal off the chambers 62A and 62B, thus forming pie-wedge-shaped (e.g., approximately triangular) chambers in cross-section.

Opposing longitudinal edges of the main baffle 65 are then bonded to the edges of the lateral baffles 66A and 71A, and 66B and 71B, respectively. The main baffle 65 effectively divides the remaining chamber of the cell 44A into two chambers, the upper main chamber 60 and the lower main chamber 61, and thus helps retain the overall shape of the cell 44A.

In order to finish construction of the cell 44A, end walls 76A and B are bonded about their edges to opposing ends of the single sheet of vinyl making up the arcuate external walls 67A, 67B, 69, 70A, 70B, 72A, 72B, 73, 75, and 77 of the cells 44A and 44B, as shown in FIGS. 5J and K.

The outside right and left cells 46A and 46B are similarly shaped to the inside right and left cells 44A and 44B (shown in FIGS. 5B, 5C, 5J and 5K), and, as noted above and shown in FIGS. 5D and 5E, are mirror images of one another. Referring to FIGS. 5D and 5E, the outside right and left cells 46A and 46B comprise a plurality of chambers with arcuate external walls. As above, this unique combination of chambers with arcuate external walls enables the outside right and left cells 46A and 46B, to substantially adapt to and maintain the theoretical trapezoidal cross-section of the outside cell receptacles 122A and 122B, as shown in FIG. 1, even though the outside cells 46A and 46B are made from a flexible material such as vinyl.

Referring to FIG. 5E, the chambers comprise an upper main chamber 80, a lower main chamber 81, two upper bulbous chambers 83A and 83B angularly extending outwardly and upwardly from the upper main chamber 80, and two lateral chambers 82A and 82B extending laterally from the upper and lower main chambers 80 and 81.

The upper main chamber 80 is substantially octagonal in cross-sectional shape, having a main baffle 84 acting generally as a horizontal base, two upper lateral baffles 85A and 85B angularly extending outwardly and upwardly from opposing ends of the main baffle 84, two arcuate upper side walls 86A and 86B extending upwardly from upper ends of the lateral baffles 85A and 85B, two upper bulbous baffles 87A and 87B angularly extending inwardly and upwardly from upper ends of the arcuate upper side walls 86A and 86B, and an arcuate top wall 89 extending between upper ends of the upper bulbous baffles 87A and 87B.

The upper bulbous chambers 83A and 83B are substantially semi-circular in cross-sectional shape, with upper bulbous chamber 83B being slightly larger than upper bulbous chamber 83A to enable the cell 46B to adapt to the slope of the trapezoidal cross-section of the upper end of the outside cell receptacle 122A and 122B. The chambers 83A and 83B are formed by upper bulbous arcuate walls 88A and 88B extending from one end of the upper bulbous baffles 87A and 87B, respectively, to the other end of the upper bulbous baffles 87A and 87B, respectively.

The lower main chamber 81 is substantially approximately circular in cross-sectional shape. The upper and lower main chambers 80 and 81 share the main baffle 84 as a common baffle between the chambers. However, with the lower chamber 81, the main baffle 84 acts generally as a horizontal ceiling. In addition, the lower main chamber 81 comprises lower lateral baffles 90A and 90B angularly extending outwardly and downwardly from opposing ends of the main baffle 84 and an arcuate bottom wall 92 extending between lower ends of the lower lateral baffles 90A and 90B. The arcuate bottom wall 92 doubles as side walls for the lower main chamber 81. In addition, the bottom wall 92 includes a manifold connector 38.

The lateral chambers 82A and 82B are substantially pie-wedge shaped in cross-section (e.g., approximately triangular with three substantially arcuate sides), being formed by lateral arcuate walls 91A and 91B extending from upper ends of the upper lateral baffles 85A and 85B to lower ends of the lower lateral baffles 90A and 90B.

Each of the baffles 84, 85A and 85B, 87A and 87B, 90A and 90B include apertures (not shown, but like 36 of FIG. 5K) therethrough. The apertures 36 allow passage of air between the various chambers to balance the air pressure therebetween.

Preferably, the external walls 86A, 86B, 88A, 88B, 89, 91A, 91B, and 92 of the chambers 80, 81, 82A, 82B, 83A and 83B are constructed out of a single sheet of vinyl having its two longitudinal edges bonded to one another. The upper bulbous chambers 83A and 83B are formed by bonding opposing longitudinal edges of the upper bulbous baffles 87A and 87B to the single sheet of vinyl. Preferably, the length of the single sheet of vinyl that is essentially trapped between the bonded edges of the baffles 87A and 87B is greater than the width of each of the baffles 87A and 87B. As a result the baffles 87A and 87B form chords to arcs, with the arcs being the bulbous arcuate walls 88A and 88B of the bulbous chambers 83A and 83B, respectively.

The lateral chambers 82A and 82B are similarly constructed. Upper longitudinal edges of the upper lateral baffles 85A and 85B and lower longitudinal edges of the lower lateral baffles 90A and 90B are bonded to the single sheet of vinyl. Lower longitudinal edges of the upper lateral baffles 85A and 85B and upper longitudinal edges of the lower lateral baffles 90A and 90B are then bonded together to seal off the chambers 82A and 82B, thus forming pie-wedge shaped (e.g., approximately triangular) chambers in cross-section.

Opposing longitudinal edges of the main baffle 84 am then bonded to the edges of the lateral baffles 85A and 90A, and 85B and 90B, respectively. The main baffle 84 effectively divides the remaining chamber of the cell 46A into two chambers, the upper main chamber 80 and the lower main chamber 81, and thus helps retain the overall shape of the cell 46A.

In order to finish construction of the cell 46A, an end wall 93 is bonded about its edges to opposing ends of the single sheet of vinyl making up the arcuate external walls 86A, 86B, 88A, 88B, 89, 91A, 91B, and 92 of the cells 46A and 46B (similarly located to end walls 76A and 76B of FIGS. 5J and 5K).

Referring to FIGS. 5F and 5G, the border cells 48A and 48B comprise a top wall 94, a bottom wall 95, two opposing side walls 96A and 96B, and two opposing end walls 97 (similarly located to end walls 76A and 76B of FIGS. 5J and 5K), all of which are bonded together about their edges. The top, bottom, and side walls 94, 95, 96A and 96B form a substantially rectangular cross-sectional shape. Internal horizontal walls 98A and 98B are located approximately equidistant from a midpoint between the top and bottom walls 94 and 95, and are bonded about their edges to the side walls 96A and 96B. The horizontal walls 98A and 98B include apertures (not shown) therethrough to allow passage of air between chambers formed by the horizontal walls 98A and 98B and enable the balance of or pressure therebetween. The internal horizontal walls 98A and 98B are used to help maintain this substantially rectangular cross-sectional shape. The bottom wall 95 of the border cells 48A and 48B includes a manifold connector 38.

A cell liner 100, shown in FIG. 3B and partially in FIGS. 4D, 4E, 5H, and 5I, and briefly discussed above, is configured to receive and retain the air cells 20 and 40. Preferably, the cell liner 100 is constructed from "ripstop" material, which is a nylon fabric akin to parachute nylon, to allow the cells 20 and 40 to easily slide against adjacent cell liner walls. This is particularly beneficial during the turning operation. Each cell 40 can properly deflate and then inflate while sliding against an adjacent cell inner wall. Without the cell liner 100, adjacent cells 40 could catch on one another and force or be forced out of position.

As is shown in FIG. 3B, the cell liner 100 is configured into three regions, a torso region or turning cell liner 100A, a head region liner 100B, and a foot/leg region liner 100C. The torso region or turning cell liner 100A is discussed above. The head region 100B and foot/leg region 100C comprise cell liners for the transverse cells 20. The regions 100B and C each comprise a top wall 102, a bottom wall 104, and two opposing side walls 107A and 107B which are bonded together at their respective edges. Internal walls 108, are spaced substantially equidistantly apart and parallel to the side walls 107A and 107B, and are each bonded to the top and bottom walls 102 and 104 to form generally equally sized transverse cell receptacles 110 adapted to receive and retain the transverse cells 20. The ends of the cell liner 100B and 100C may remain open to allow the cells 20 to be easily slid in or out. In addition, the bottom walls 104 of the cell liners 100B and 100C have apertures 129 therethrough for cell and manifold connectors 148 (discussed below) and 38 to interconnect.

The torso region or turning cell liner 100A comprises top, bottom, side, fulcrum, inner, and border walls 102, 104,106, 112, 116 and 120, as discussed above. In addition, the torso liner region 100A is closed on one end by an end wall 111, as shown in FIG. 3B. The torso liner 100A also has a dart (not shown) pulled in each of the side, fulcrum, inside, and border walls 106, 112, 116, and 120 along an area near the foot/leg region. The dart is largest at a point near the foot/leg region. The dart is used to substantially downwardly retain the ends of the turning cells 40 near the foot/leg region at a level equal to the foot/leg region air cells 20 and to minimize the "hammock" effect caused when a patient is retained on the turning cells 40. The bottom wall 104 of the cell liner 100A has apertures 129 therethrough for cell and manifold connectors 148 (discussed below) and 38 to interconnect.

The cell liner regions 100A, 100B, and 100C may be hingedly connected at top edge seams 128A, 128B and 128C or the top walls 102 of each cell liner region 100A, 100B, and 100C may be comprised of a single wall encompassing all three cell liner regions 100A, 100B, and 100C. These configurations allow easy storage of the turning air mattress cells 20 and 40 and cell liner 100, in addition to easy access to the different liner regions 100A, 100B and 100C.

Figures 7A, 7B, 7C, 7D:
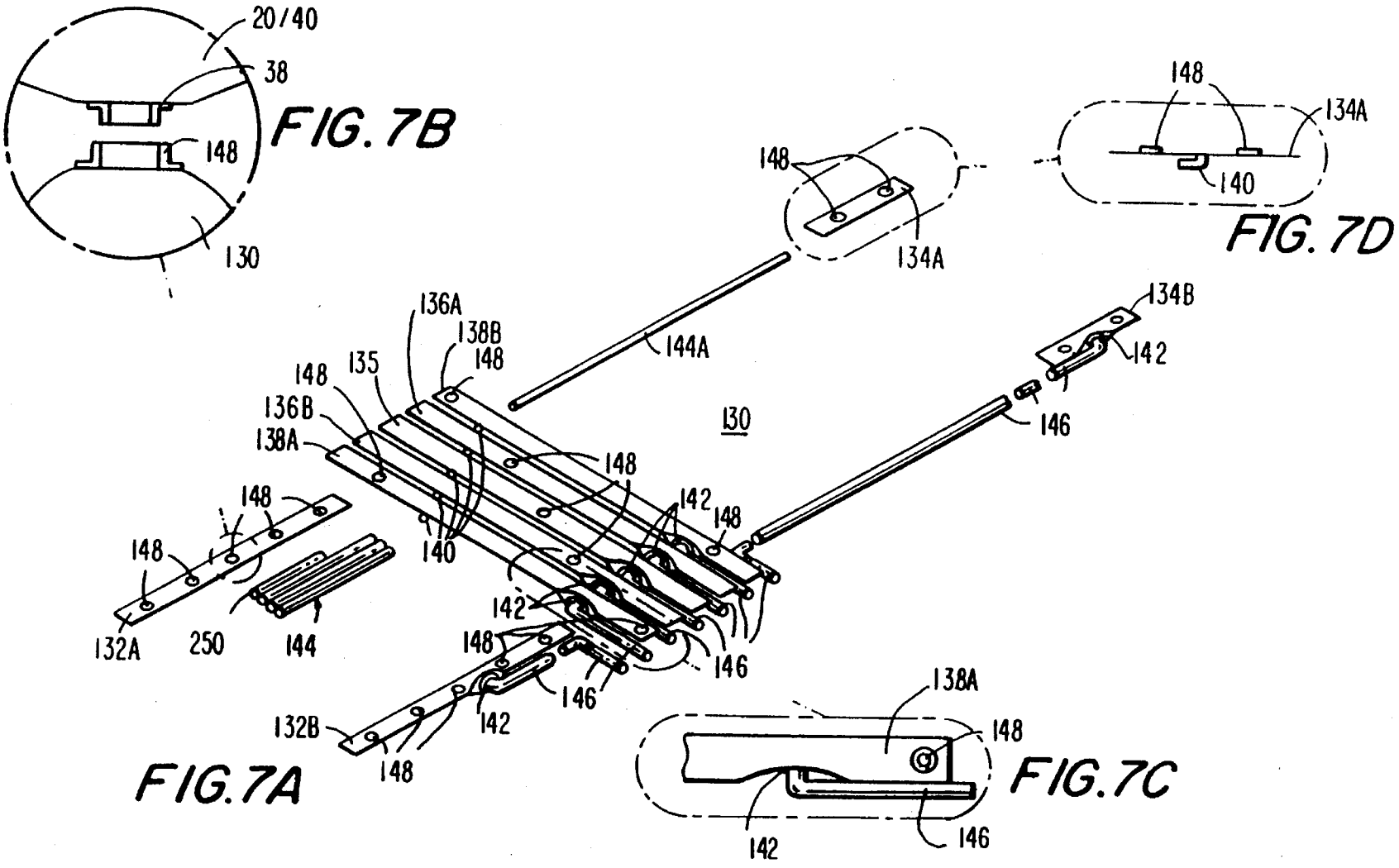
FIG. 7A is an exploded view of the manifolds, air supply tubing, and exhaust tubing of FIGS. 1 and 2.
FIG. 7B is a detailed view of a cell and manifold connection.
FIG. 7C is a side detail view of a manifold showing cell connectors and a manifold inlet connection.
FIG. 7D is a partial side detail view of a manifold showing a manifold connector, a CPR outlet and CPR exhaust tubing.

Referring to FIG. 7A, a plurality of cell manifolds 130 distribute air to and from the different Zones I, II, III, IV, V, and VI of air cells 20 and 40 (shown in FIG. 6). There are preferably two head region manifolds 134A and 134B, two foot/leg region manifolds 132A and 132B, and five torso region manifolds 135, 136A, 136B, 138A and 138B. The manifolds 130 are oriented to lie substantially flat on the base 150 and generally traverse the base 150 in a perpendicular direction to the longitudinal axis of the cells 20 and 40 of the respective regions. The head region manifolds 134A and 134B comprise an inlet/exhaust manifold 134A and a CPR exhaust manifold 134B, each manifold having two cell connectors 148 to enable connections to the manifold connectors 38 on the transverse air cells 20, as shown in FIG. 7B. The inlet/exhaust manifold 134A supplies air to and exhausts air from the transverse cells 20 in the head region during normal operation through an air supply connection 140, as shown in FIG. 7C. The CPR exhaust manifold 134B has a CPR outlet connection 142, as shown in FIG. 7D, to exhaust air rapidly from the transverse cells 20 to administer CPR.

The foot/leg region manifolds 132A and 132B similarly comprise an inlet/exhaust manifold 132A having an air supply connection 140 and a CPR exhaust manifold 132B having a CPR outlet connection 142. However, the foot/leg region manifolds 132A and 132B each comprise five cell connectors 148 to communicate with five transverse cells 20—the three cells 20 in the leg region and the two cells 20 in the foot region.

The torso region manifolds 135, 136A, 136B, 138A and 138B comprise a fulcrum manifold 135 connected to the fulcrum cell 42 and interconnected to the head region inlet/exhaust manifold 134A via air supply tubing 144A; an inside right manifold 136A connected to the inside right cell 44A; an inside left manifold 136B connected to the inside left cell 44B; an outside right manifold 138A connected to a combination of the outside right cell 46A and the left border cell 48B; and an outside left manifold 138B connected to a combination of the outside left cell 46B and the right border cell 48A. Each of the manifolds has an air supply inlet 140 and a CPR outlet connection 142, and a cell connector 148 for each turning cell 40 that is to be connected to the manifold 135, 136A, 136B, 138A and 138B (i.e., manifolds 138A and 138B include two cell connectors 148 each because each manifold 138A and 138B is to be connected to two turning cells 40—an outside cell 46 and a border cell 48).

In a preferred construction, the manifolds 130 are constructed from vinyl to insure that they are substantially air and fluid impermeable while remaining flexible. Additionally, the cell connectors 148, as well as the manifold connectors 38 attached to the air cells 20 and 40, are a flexible Halkey-Roberts, U.S. Pat. No. 2,777,490 type connector that ensures the passage of air between the air cells 20 and 40 and manifolds 130 in a substantially air-tight manner. As seen in FIG. 7B, the male manifold connector 38 is bonded to an air cell 20 or 40, and the female cell connector 148 is bonded to a manifold 130.

Turning back to FIG. 1, a base 150 is retained atop of the bed frame F with interengaging straps 168. Referring to FIGS. 8A–C and 10, the base 150 comprises foam padding 152 strategically placed on top of a bottom cover 158 of the base 150 to form channels 156 in the foam. The channels 156 are adapted to receive and unconnectedly retain the manifolds 130, and also, to accommodate air supply and CPR exhaust tubing 144 and 146 (shown in FIG. 7A). The padding 152A and 152B serves a dual purpose of supporting the patient when the air cells 20 and 40 are deflated to administer CPR and to ensure that the air passages through the manifolds 130, as well as through the air supply and CPR exhaust tubing 144 and 146, remain unobstructed. The air supply tubing 144, which includes a low air loss line 250 (shown in FIG. 7A), enters the base 150 through a series of holes 169 in the bottom cover 158.

The foam padding 152 is held in place by padding covers 154 which are bonded to the bottom cover 158 of the base 150. The base 150 also includes opposing end and side covers 162 and 160 bonded to the bottom cover 158. The end and side covers 162 and 160 extend above the foam padding 152 forming an inverted fitted sheet type configuration to receive the air cells 20 and 40. A fastener 164B, such as a zipper, is attached to the top unbonded edges of the side and end covers 160 and 162. The fastener 164B enables connecting the base 150 and the top cover 15 as is described below.

Figure 8A:
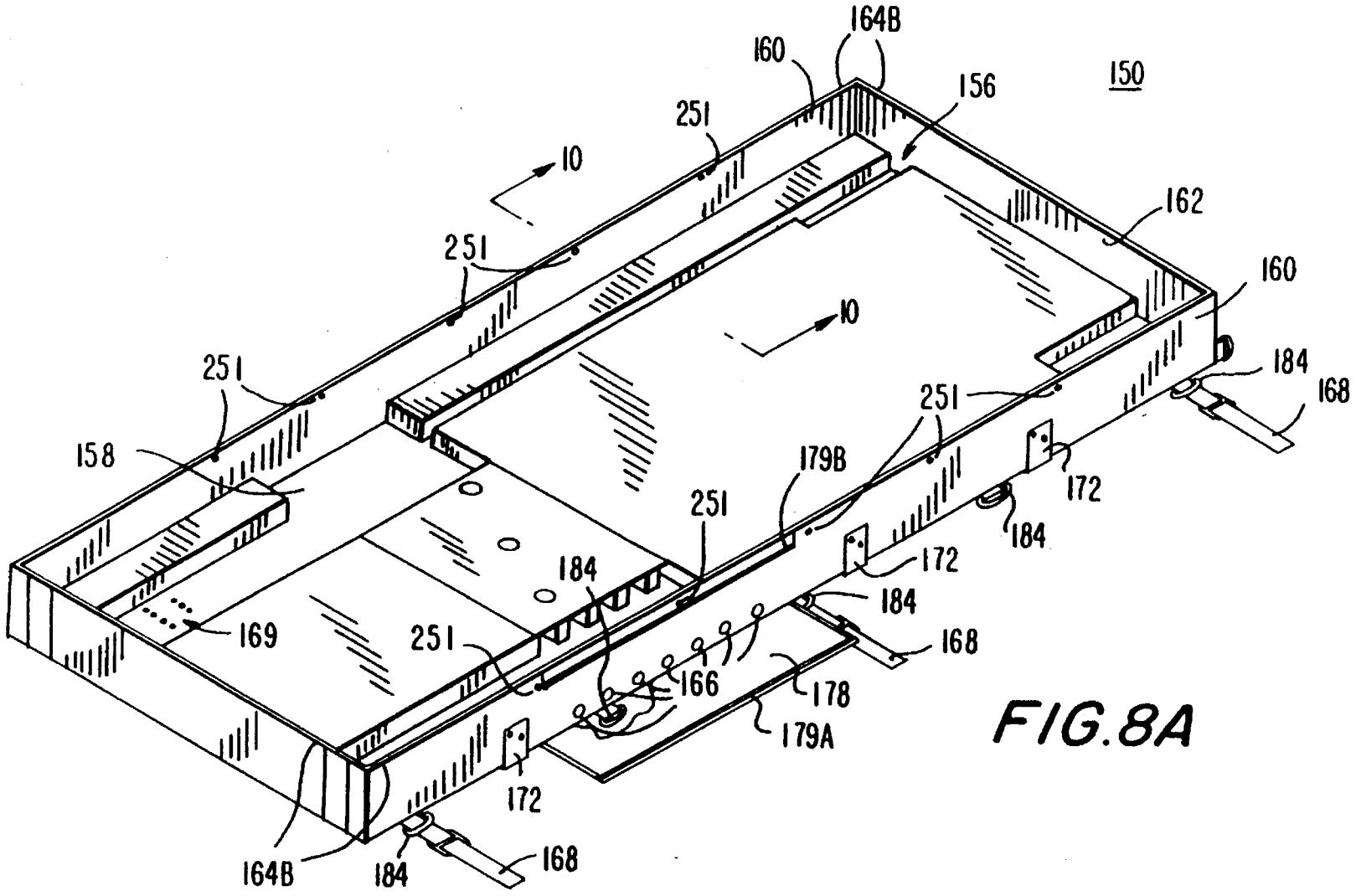
FIG. 8A is a perspective view of the base of FIGS. 1 and 2.
Figure 8B:
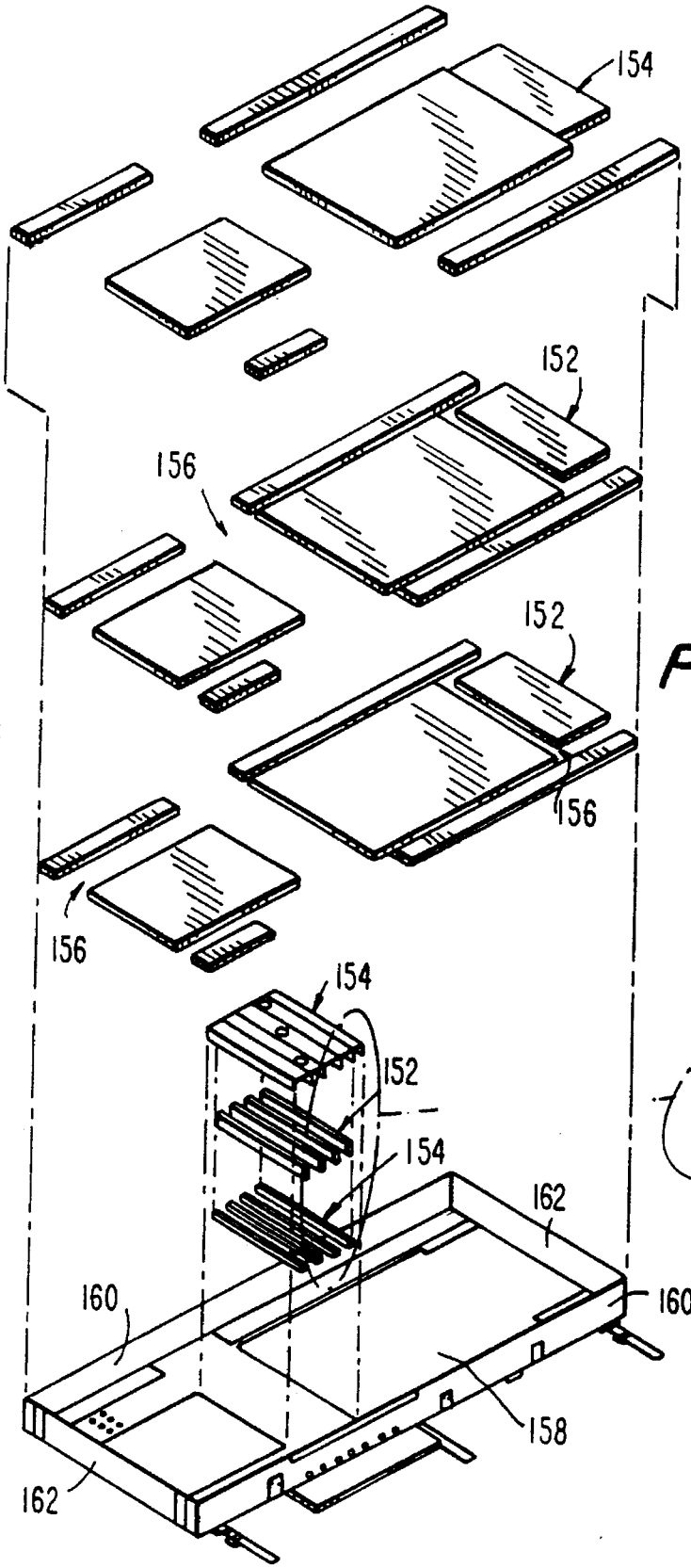
FIG. 8B is an exploded view of the base of FIG. 8A.
Figure 8C:
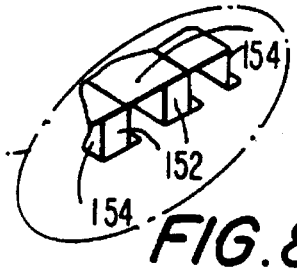
FIG. 8C is a detailed view of part of the base assembly.
Figures 9A, 9B, 9C:
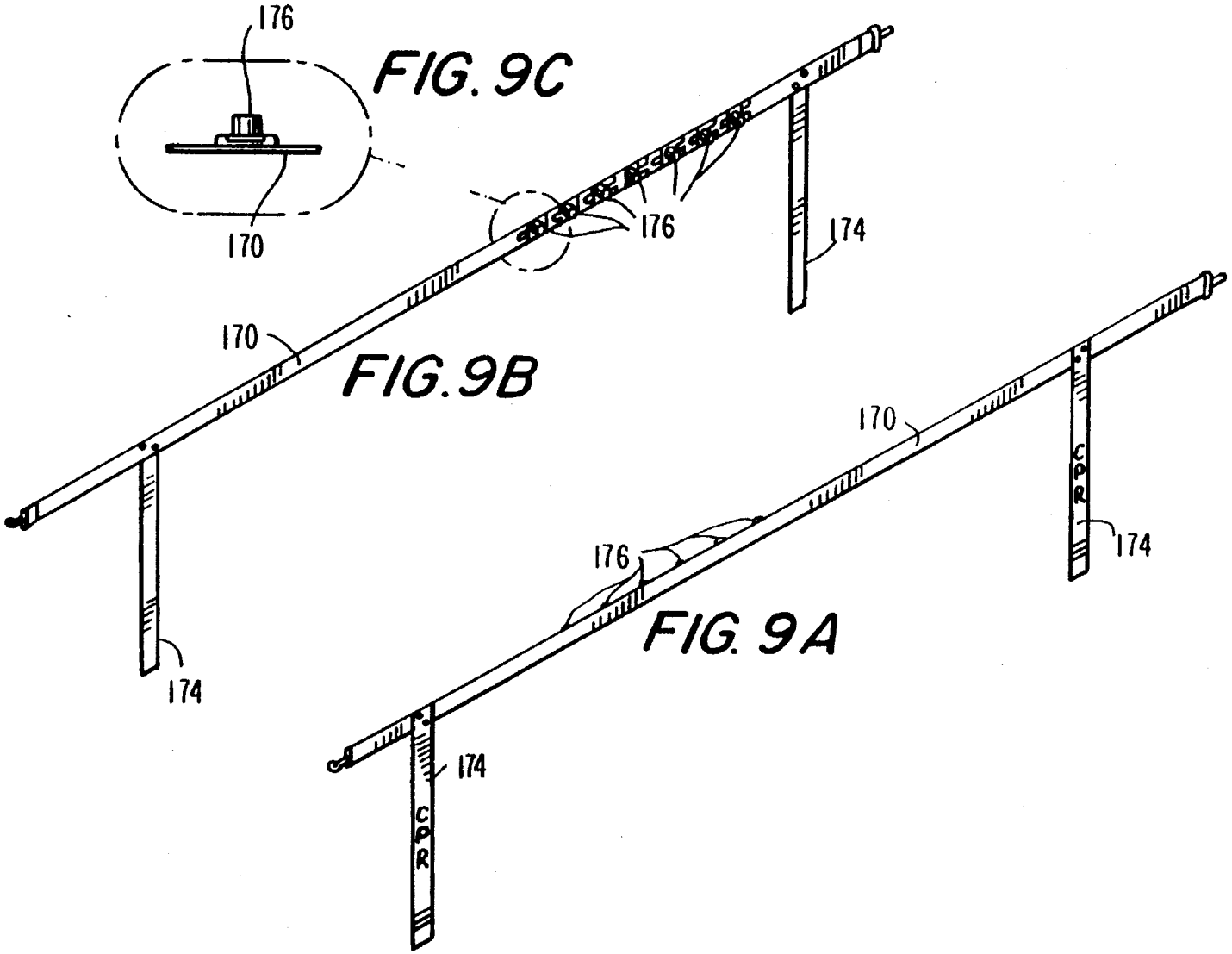
FIG. 9A is a perspective view of the CPR strap of FIGS. 1 and 2.
FIG. 9B is a mirror image perspective view of the CPR strap in FIG. 9A.
FIG. 9C is a partial detail view of the CPR strap and plug in FIG. 9B.

As shown in FIG. 1, a CPR pull strap 170, made from, for example, a band of heavy cloth, is retained against a side cover 160 of the base 150 by a series of retaining loops 172 (shown in FIGS. 8A and 8B). Referring to FIGS. 9A, 9B and 9C, the CPR strap 170 includes a series of plugs 176 used to plug the CPR exhaust tubing 146 which is connected to the CPR outlets 142 of the manifolds 130. Two pull handles 174 are attached to the CPR strap 170 and are used to pull the CPR strap 170 to dislodge the plugs 176 from the exhaust tubing 146. Dislodging the plugs 176 allows the rapid exhaust of air from the cells 20 and 40.

As is shown in FIG. 8A, the plugs 170 access the tubing 146 through a series of holes 166 located in the side cover 160 of the base 150. A protective flap 178, bonded at one edge to the side cover 160 and connected at another edge to the side cover 160 by a fastener 179A and 179B, such as a zipper, helps prevent the plugs 176 from being inadvertently dislodged from the tubing 146.

Figure 11:
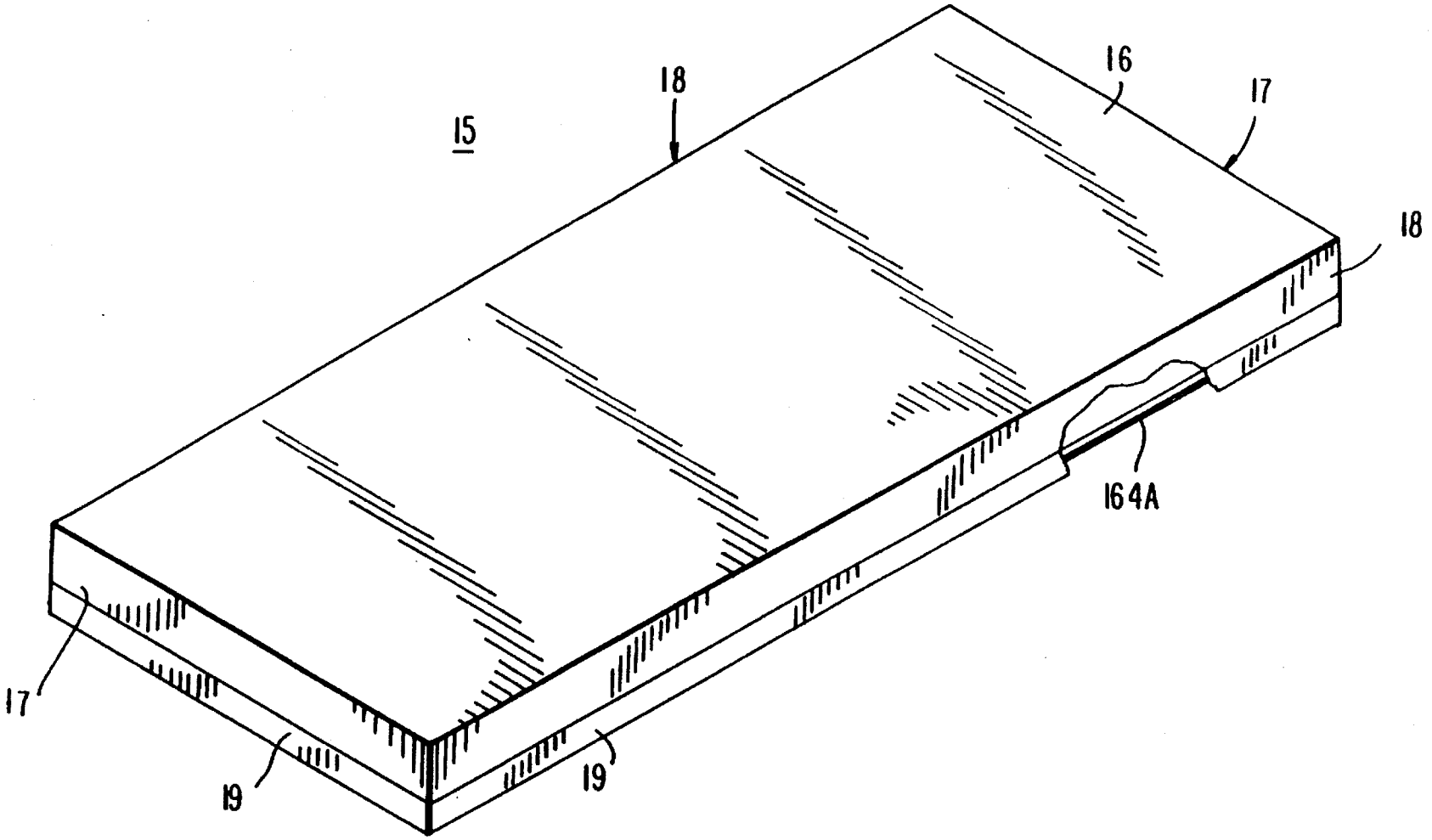
FIG. 11 is a perspective view of the top cover of FIGS. 1 and 2.

Referring to FIGS. 1 and 2, after the manifolds 130 and air cells 20 and 40 are received within the base 150, a top cover 15 is attached to the base 150 to retain the cells 20 and 40. Referring to FIG. 11, the top cover 15 comprises a top wall 16, two opposing side walls 18, and two opposing end walls 17 bonded to each other about their edges. A top cover fastener 164A, such as a zipper, is attached to the lower unbonded edges of the side and end walls 18 and 17. The top cover fastener 164A is used to engage the base fastener 164B to attach the top cover 15 to the base 150. A protective flap 19 hangs down from the non-bonded edges of the side and end walls 18 and 17 to cover the fasteners 164A and 164B.

Figure 12:
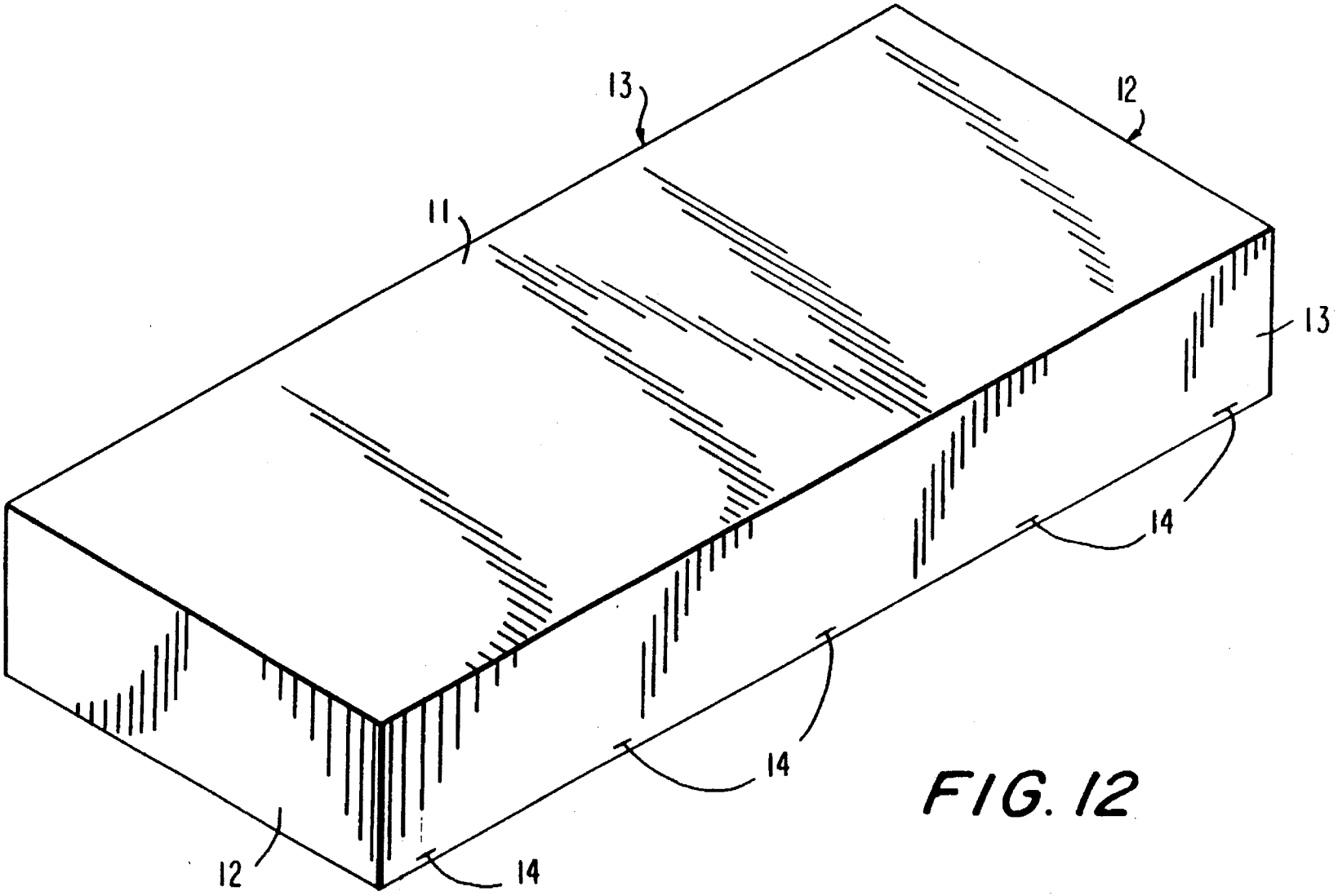
FIG. 12 is a perspective view of the fleece of FIGS. 1 and 2.

Also shown in FIGS. 1 and 2, a fleece 10, used to cushion the contact between the patient and the top cover 15 and underlying cells 20 and 40, is placed over the top cover 15 and base 150 in a similar fashion to a fitted sheet over a standard mattress. Referring to FIG. 12, the fleece 15 is preferably constructed from a soft blanket-like material and comprises a top wall 11, two opposing end walls 12, and two opposing side walls 13. A series of tie slits 14, preferably a total of five tie slits 14, are approximately equally spaced along the lower end of the side walls 13.

Figure 10:
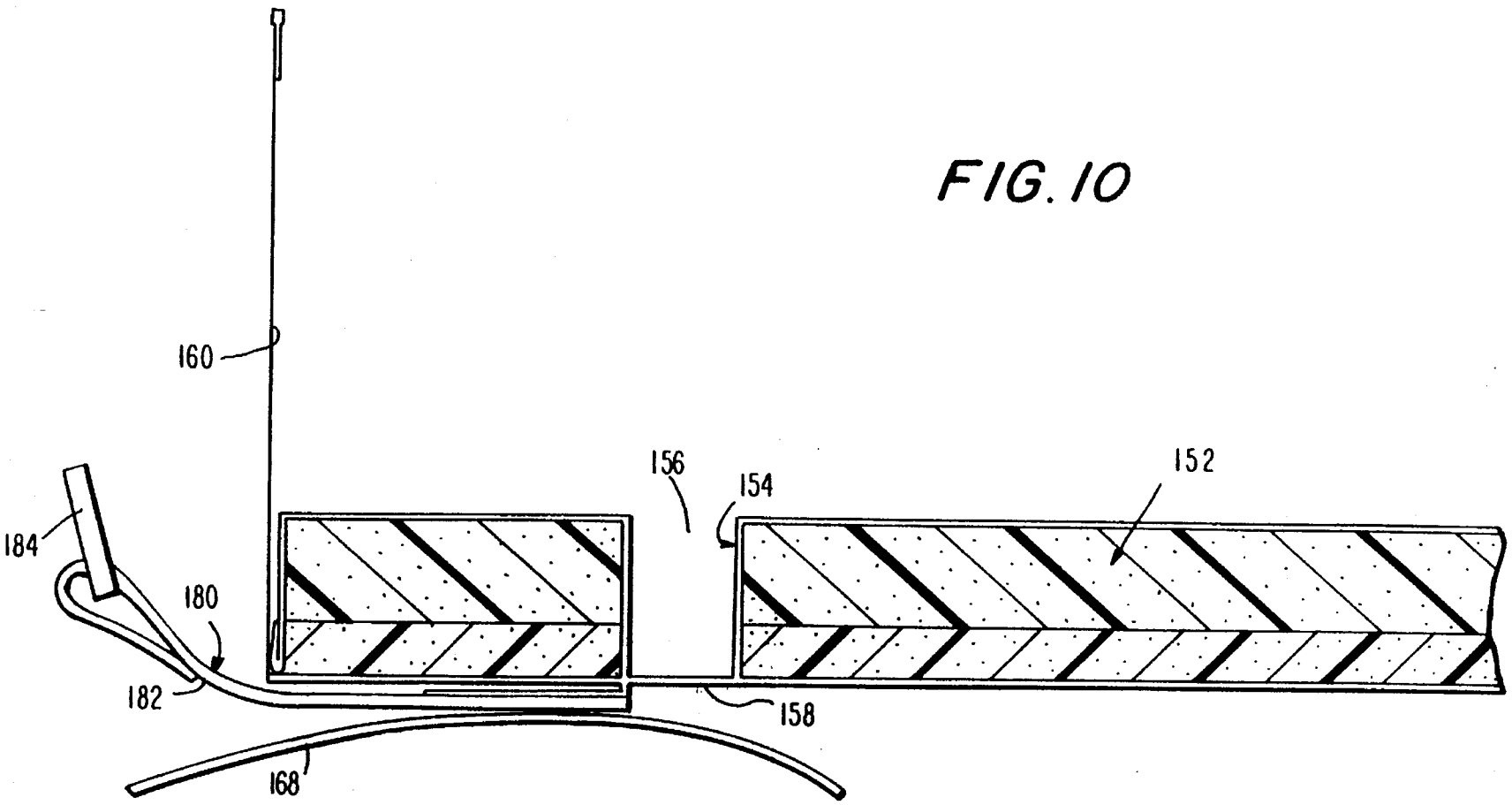
FIG. 10 is a partial cross-sectional view of the base, ties and straps taken along a line 10—10 in FIG. 8A.

The fleece 10 is preferably held in place by a series of ties 180 attached to the underside of the bottom cover 158 of the base 150, as shown in FIGS. 1, 8A and 10. The ties 180 comprise an elastic tie strap 182 and a tie clasp 184 attached to the end of the tie strap 182. The tie clasps 184 may pass through the tie slits 14 in the side walls 13 of the fleece 10 and thereby retain the fleece 10 in communication with the tie straps 182.

Figure 13:
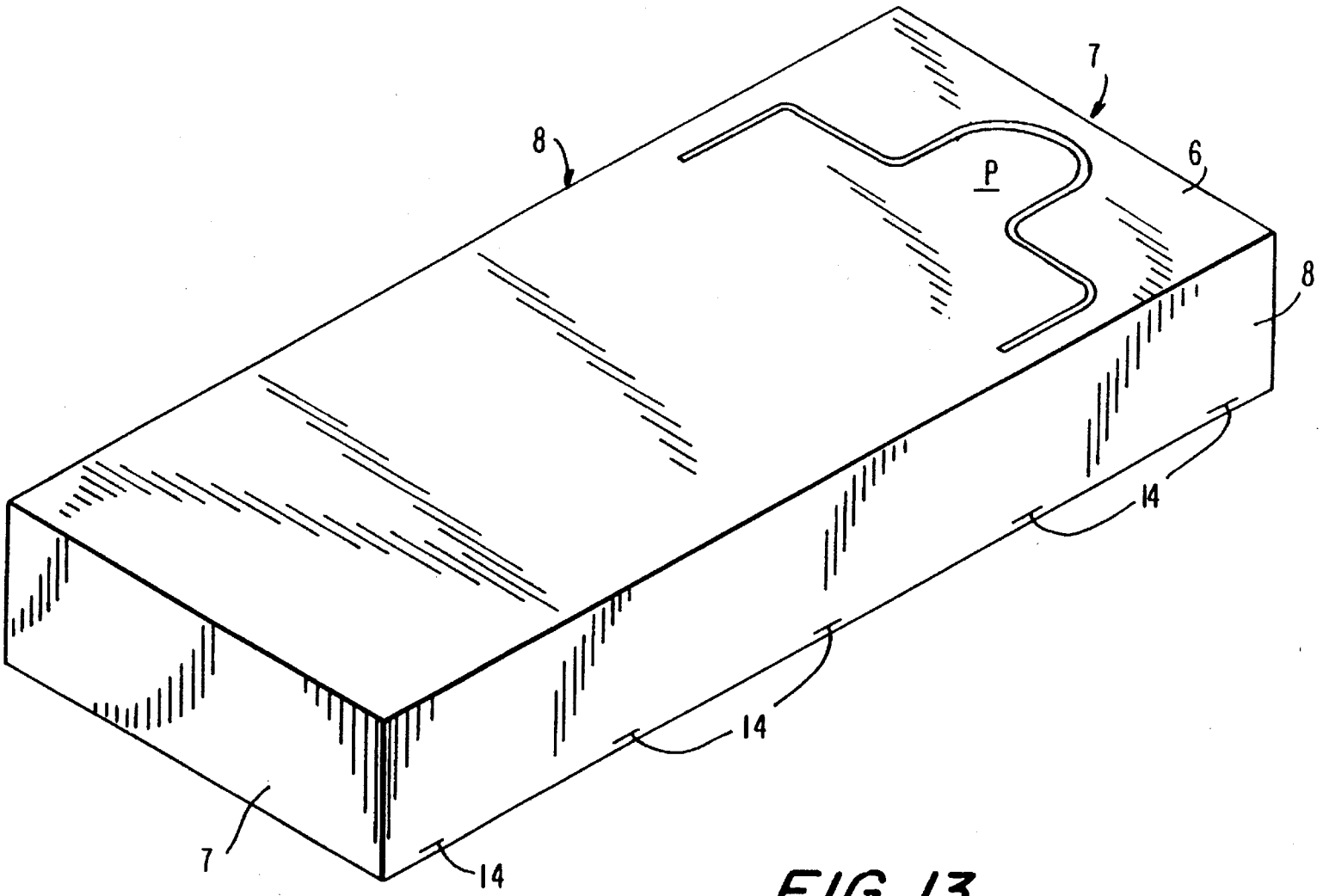
FIG. 13 is a perspective view of the top sheet of FIGS. 1 and 2.

Referring to FIG. 13, a top sheet 5 comprising a top wall 6, two opposing end walls 7, and two opposing side walls 8 with five approximately equally spaced tie slits 14, is held in place like a fitted sheet, in like fashion to the fleece 10, over the fleece 10, by the same ties 180 described above. The top sheet 5 is a semi-permeable sheet designed to receive pressurized air and disburse the air across the total width and length of top wall 6 of the top sheet 5, providing a blanket of gentle flowing air passing upward around the patient's body. The air is needed to maintain the dryness of the patient's skin so that contact with the sheet 5, fleece 10, top cover 15, and cells 20 and 40 reduces the development of rashes or other forms of irritation. The top sheet 5, preferably, should also be substantially impervious to passage of liquids so that it will not allow moisture to pass down toward the top cover 15 and cells 20 and 4. The top sheet 5 receives air from the valve box via a low air loss line 250. The line 250 enters the base 150 and distributes air about the cells 20 and 40. The air then exits the base 150 through holes 251 located in the side covers 160 just below the fastener 164B.

Figure 14:
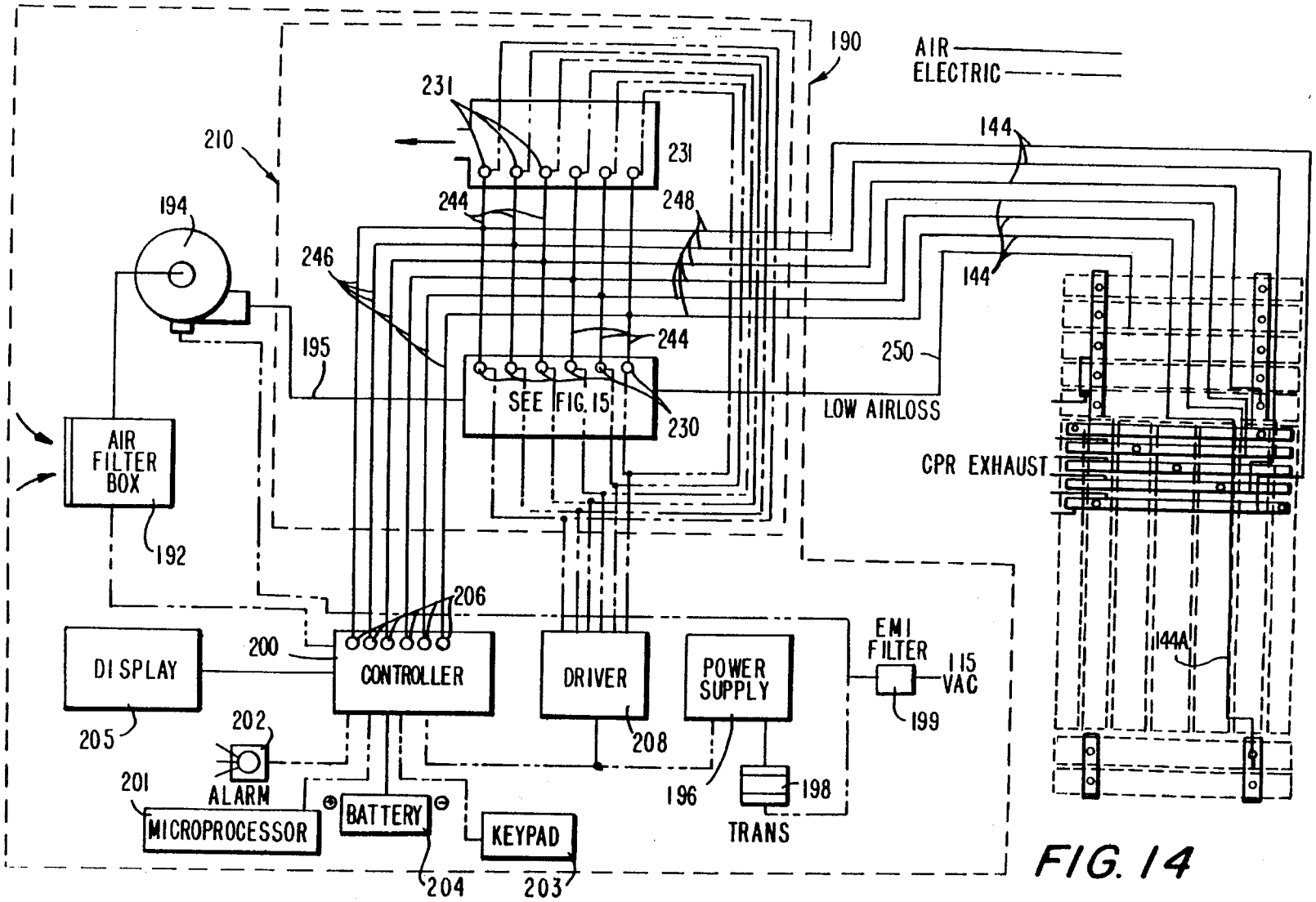
FIG. 14 is a schematic diagram of the preferred control system of the present invention.

The turning air mattress control system is located within the control box 190, schematic of which is shown in FIG. 14. Referring to FIG. 14, the control box 190 comprises a blower 194, a power supply 196, a controller 200, and a valve box 210. The blower 194 is powered by an electric motor (not shown) connected to the power supply 196. The blower 194 preferably is a single speed, constant-volume type air compressor. However, other embodiments may include a blower that is a variable-speed type compressor. The blower 190 preferably receives atmospheric air through an air filter box 192 comprising an air filter. The blower 194 provides air at a pressure in excess of the maximum required inflation pressure of the air cells 20 and 40.

The power supply 196 supplies power to all the components of the control system through an EMI filter 199. The control system comprises a resistant/compacistance-type network; thus, the EMI filter is used to trim any current spikes or pulses that might enter through the power supply. In addition, a transformer 198 is used to step down the power from the power supply 196 and supply operating and "kick voltages" to be discussed below, and also a logic voltage.

Figure 15A:
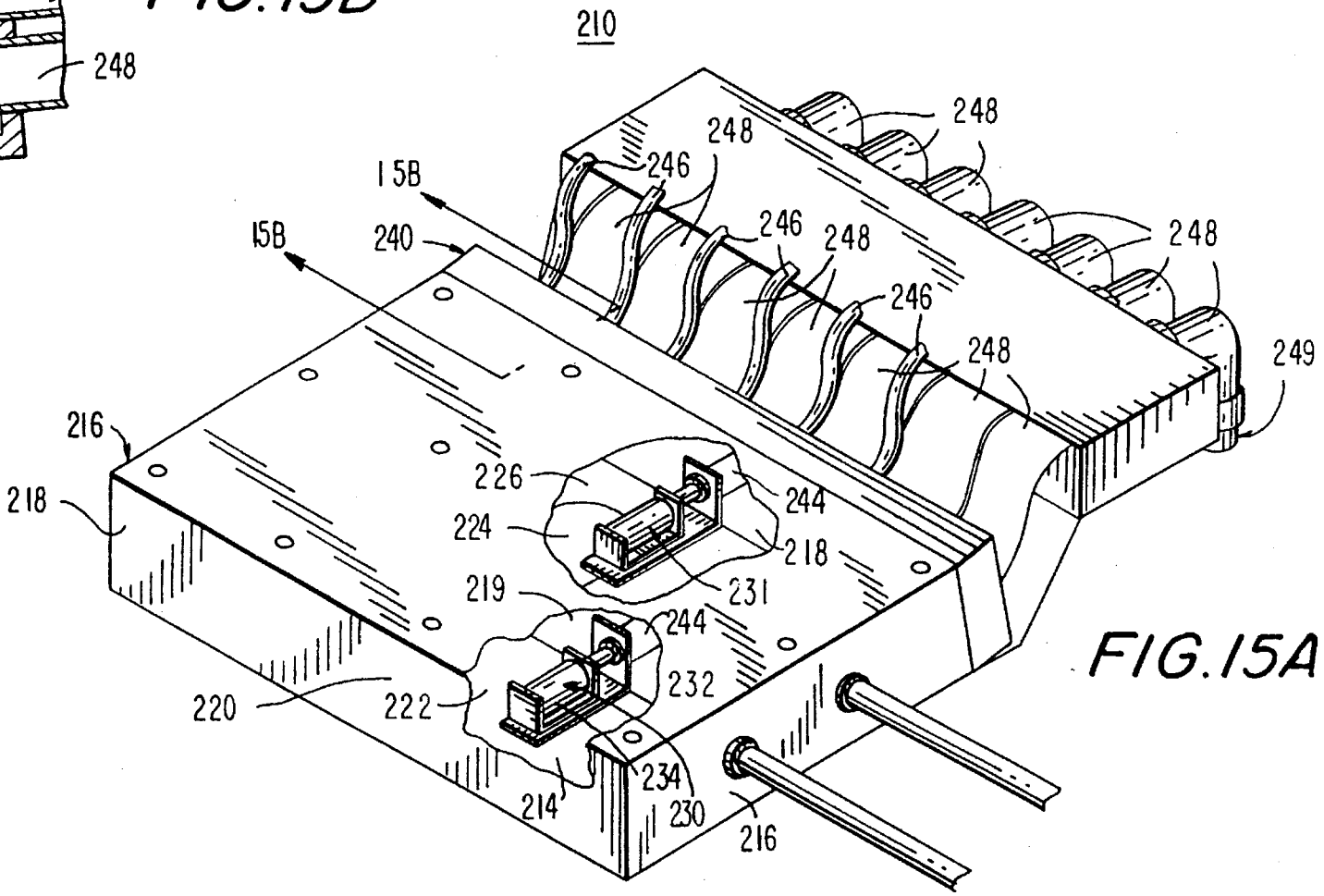
FIG. 15A is a perspective view of the valve box of the present invention.

The valve box 210 distributes high pressure air to and exhausts air from the manifolds 130 of the different Zones I–VI of cells 20 and 40. Referring to FIG. 15, the valve box 210 comprises top, bottom, opposing side, and opposing end walls 212, 214, 216, and 218. An internal wall 219 located approximately midway between the end walls 218 divides the valve box into a high pressure plenum 222 and an exhaust plenum 226. The high pressure plenum 222 includes a high pressure inlet 220 connected to the blower 194 via a main air supply tube 195 (shown in FIG. 14). The exhaust plenum 226 includes an exhaust outlet 224 open to atmosphere.

Within the high pressure plenum 222 and the exhaust plenum 226 are a series of normally closed on/off inlet and exhaust valves 230 and 231, respectively. Preferably, pairs of inlet and exhaust valves 230 and 231 correspond to the different Zones I–VI of cells 20 and 40, and are used to control the air pressure within the Zones I–VI of cells 20 and 40. The valves 230 and 231 are identical in construction and predominantly comprise a piston 232 that is actuated by activating a solenoid coil 234. When the solenoid coil 234 is activated, the piston 232 is drawn into the solenoid coil 234 opening the valves 230, 231.

Figure 15B:
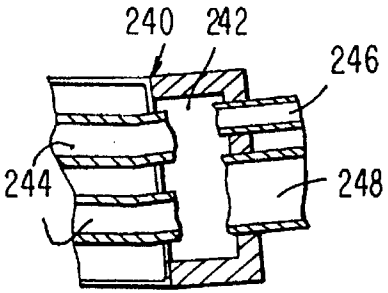
FIG. 15B is a cross-sectional view of the manifold chamber of the valve box taken along a line 15B—15B in FIG. 15A.

A valve box manifold 240 is attached to one end of the valve box 210. The manifold 240 is preferably divided into a series of chambers 242 corresponding to the different Zones I–VI of cells 20 and 40. As shown in FIG. 15B, the chambers 242 communicate with valve tubing 244A and 244B which, in turn, communicate with valves 230 and 231. The chambers 242 distribute air to the Zones I–VI of cells 20 and 40 via output tubing 248. The air supply tubing 144 connects to the output tubing 248 via quick disconnects 249 to allow for speedy assembly and disassembly. Pressure sensor tubing 246 also accesses the chambers 242, enabling the monitoring of pressure within each Zone I–VI of the turning air mattress.

Referring back to FIG. 14, the controller 200, which includes a microprocessor 201, measures cell 20 and 40 air pressures, calculates the differential between the desired and actual cell 20 and 40 air pressures, and issues electronic commands that control the inlet and exhaust valves 230 and 231 to adjust and maintain the air pressure within each cell Zone I–VI. In addition, the controller 200 includes a display 205 and a key pad 203. The display 205 is provided to show the operator the normal and existing conditions of the turning air mattress. The key pad 203 is provided to input commands to the controller's 200 microprocessor 201 and to call up various readouts on the display 205.

The controller 200 also includes a pressure sensor 206 for each Zone I–VI of cells 20 and 40 to enable the monitoring of pressure within the cells 20 and 40. The pressure sensors 206 preferably include a temperature compensated solid state pressure transducer. The output voltage of the transducers should be linearly proportional to the pressure within the cells 20 and 40 of a particular Zone I–VI, as measured at the manifold chamber 242. The output voltage may be converted to digital logic levels usable by the microprocessor 201. The microprocessor 201 may determine which pressure sensors 206 are to be read at any point in time.

A solenoid driver 208 is provided to operate the solenoid coil 234 of the inlet and exhaust valves 230 and 231. The driver 208 includes a pair of switching transistors for each solenoid 234 on each valve 230, 231. The driver 208 provides a "kick voltage" to activate the solenoid coil 234 and open the valves 230, 231. A second voltage, the "hold voltage" or normal operating voltage, is provided to hold the valves 230, 23 1 open. The voltage is supplied through the switching transistors, with the kick voltage being at least two times the normal operating voltage for the solenoid coil.

Figures 1, 17:
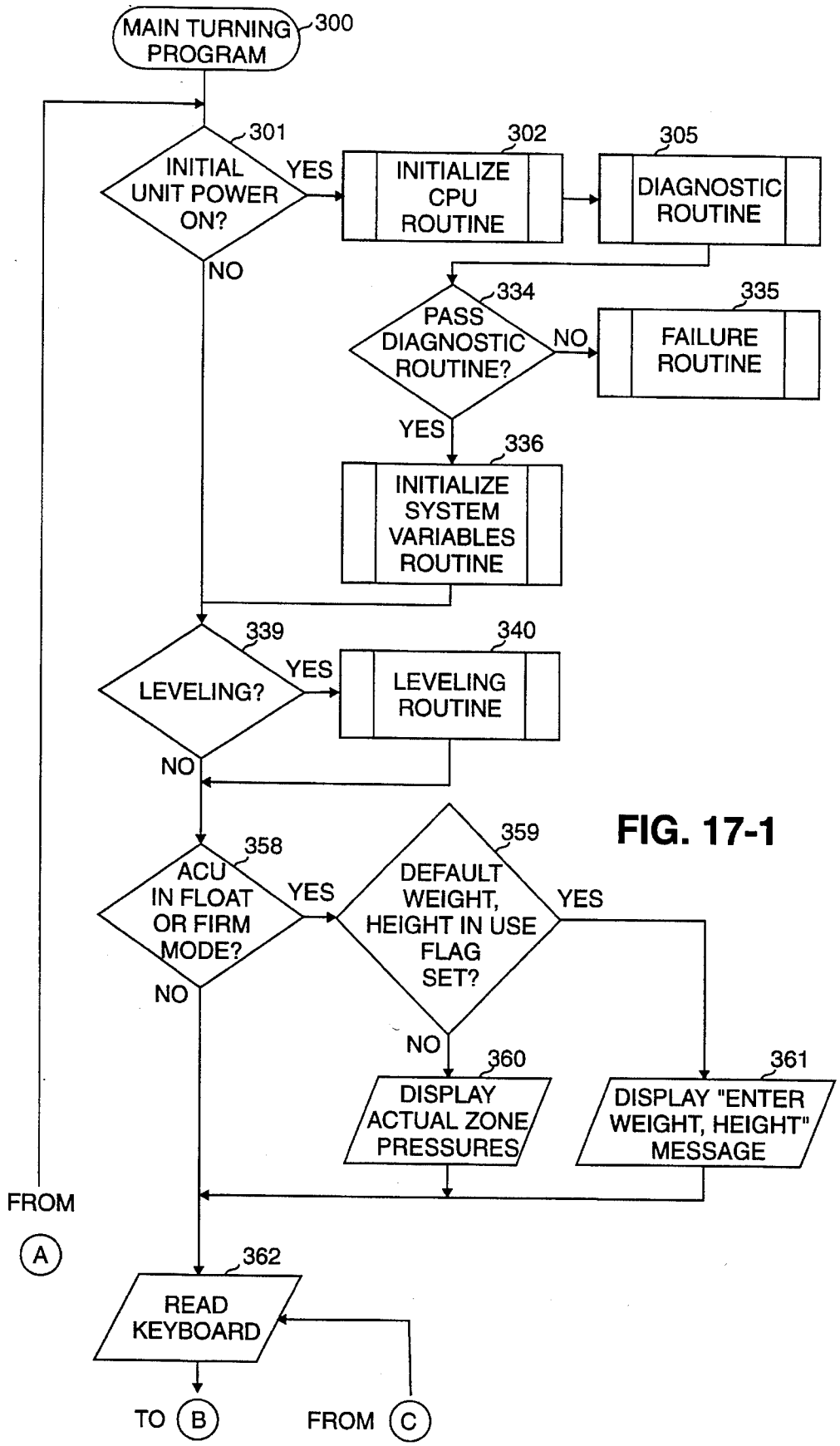
FIG. 17 is a flow chart of the turning air mattress control system.
Figures 2, 17:
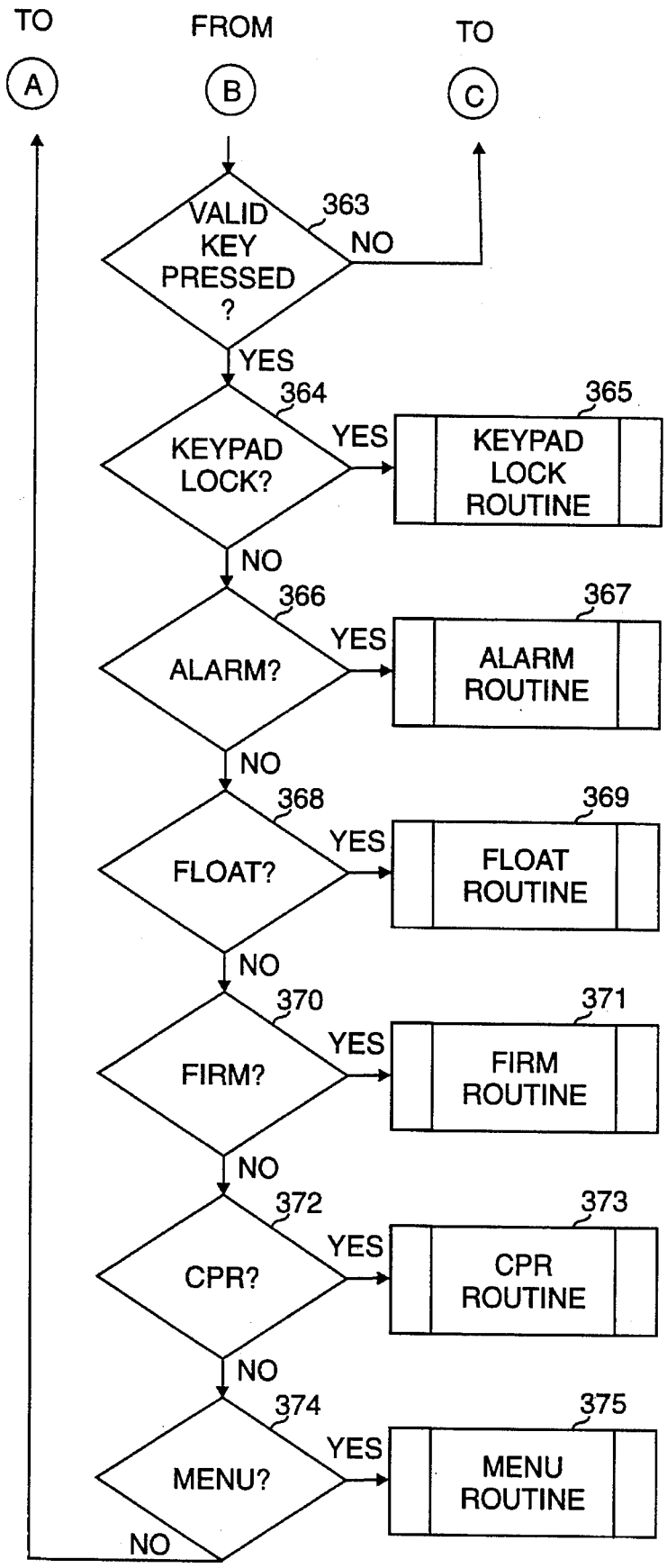
Figure 18:
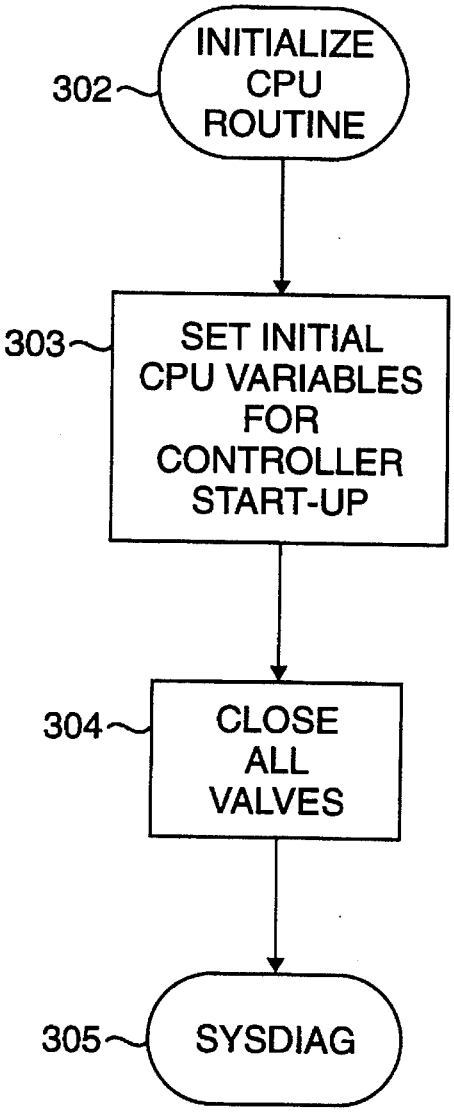
FIG. 18 is a flow chart of the initialize CPU routine of FIG. 17.

In operation, computer software routines may be used to control all system functions. Referring to FIGS. 17–25, the turning air mattress system's computer software routines are illustrated in flow chart form. A main turning program 300, comprising the steps 301–362, is shown in FIG. 17. Upon initial receipt of power, the microprocessor 201 preferably enters a subroutine of the main program 300 to initialize the central processing unit (CPU) 302. The routine 302, as shown in FIG. 18, first sets the initial CPU variables 303 by calling up these variables, such as the main turning program 300, from the non-volatile read-access-memory (NOVRAM) or other non-volatile forms of memory. Because there are no relays within the control system, electrical states throughout the control system may be random upon start-up. Therefore, the microprocessor 201 preferably closes 304 all valves 230, 231 by directing the driver 208 to cease sending any voltage to the solenoid coils 234. The microprocessor 201 then preferably performs system diagnostics in a system diagnostic subroutine 305.

Figures 1, 20:
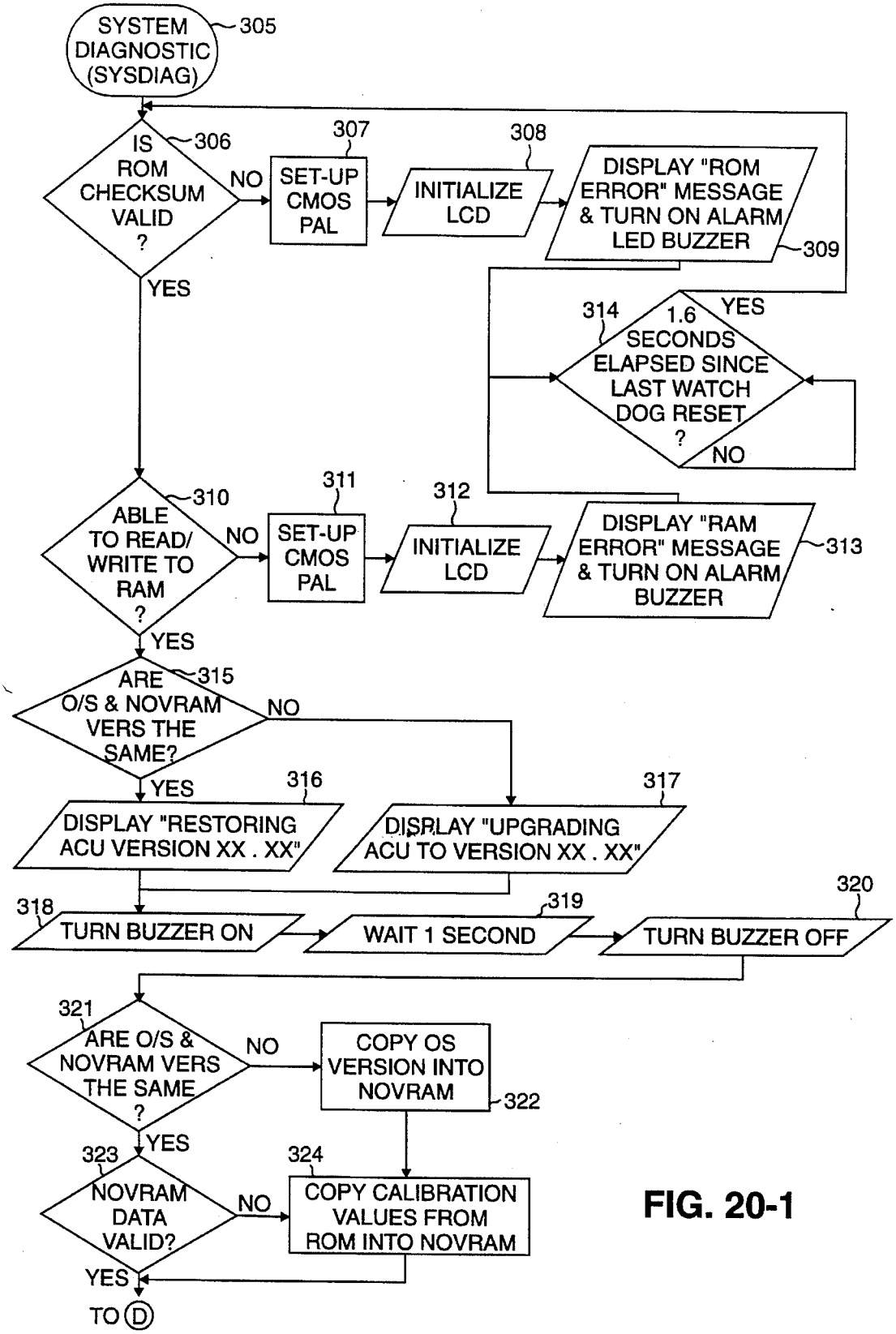
FIG. 20 is a flow chart of the system diagnostics routine of FIG. 17.
Figures 2, 20:
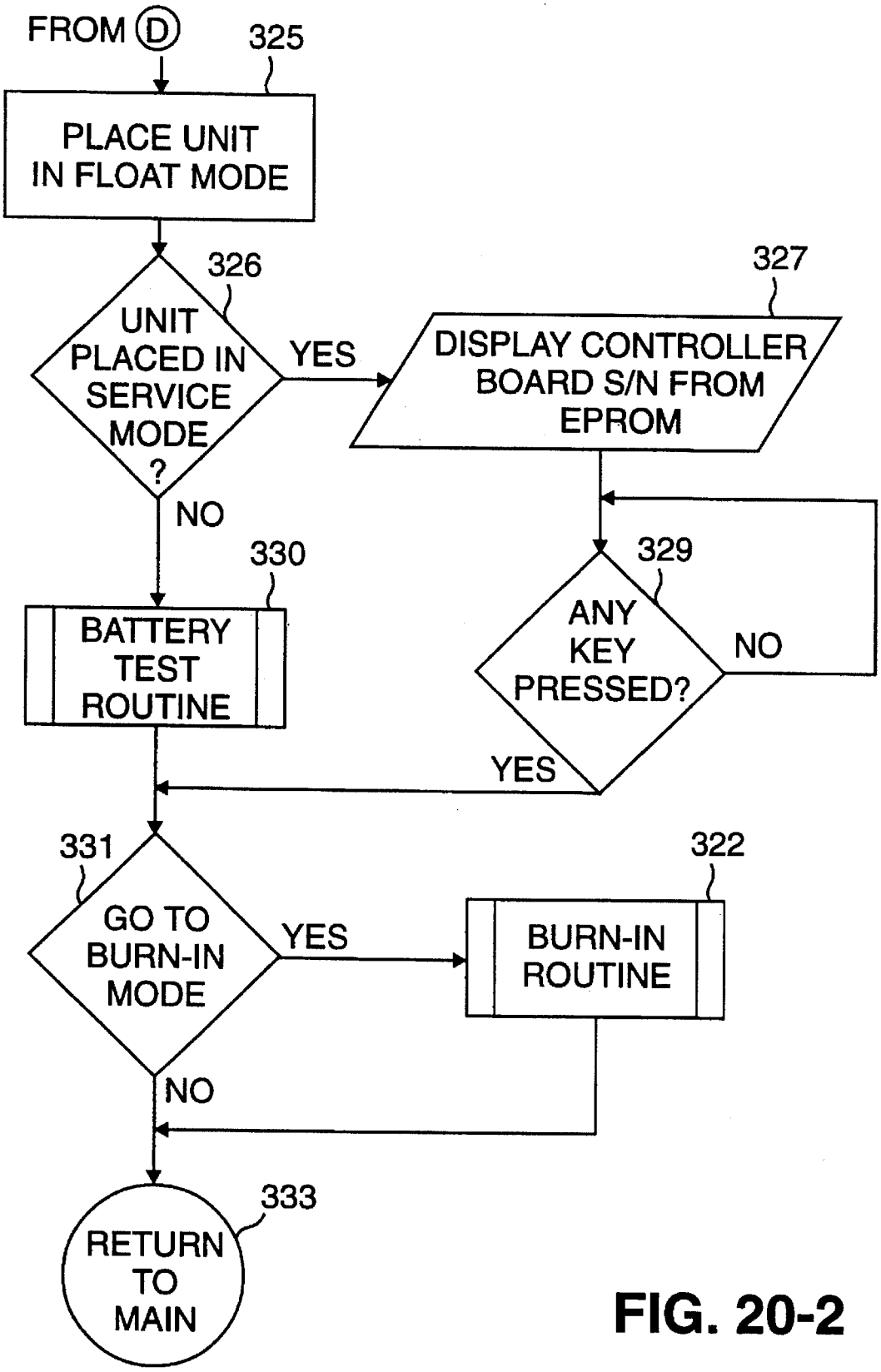

In the system diagnostic routine 305, as shown in FIG. 20, the microprocessor 201 initially determines whether the read-only-memory (ROM) checksum is valid 306. If the checksum is invalid, the microprocessor 201 will command the complementary metal oxide semiconductor (CMOS) programmable array logic (PAL) to turn the alarm light-emitting diode (LED) and buzzer 202 on indicating the checksum is invalid, and command the display 215 to show a "ROM ERROR" message 307, 308, and 309. The microprocessor 201 continues within this loop of the routine 305 after waiting 1.6 seconds 314. After determining that the system did not pass the diagnostic routine 334, the microprocessor 201 preferably enters a failure routine 335. As a result, the control system is effectively locked up and must be returned to the factory for servicing.

However, if the checksum is valid 306, the microprocessor 201 determines whether the controller 200 is able to read and write to the NOVRAM 310. If not, the microprocessor 201 will command the CMOS PAL to turn the alarm LED and buzzer 202 on indicating the problem, and command the display 215 to show a "RAM ERROR" message 311, 312 and 313. The microprocessor 201 then waits 1.6 seconds 314 before continuing within this loop. After determining that the system did not pass the diagnostic routine 334, the microprocessor 201 preferably enters a failure routine 335. As a result, the control system is effectively locked up and must be returned to the factory for servicing.

The microprocessor 201 moves on to check whether the current operating system and NOVRAM are the same version 315,321. This is important, especially in situations where updates to the operating system have been made. The microprocessor 201 displays the status of this check 316, 317 and remedies any inconsistencies by copying the current operating system to the NOVRAM 322 and the calibration values from the ROM into the NOVRAM 324. The calibration values are also copied to the NOVRAM 324 when the routine determines that the NOVRAM data is invalid 323. An alarm 202 buzzer check is also performed 318, 319, and 320.

Figure 19:
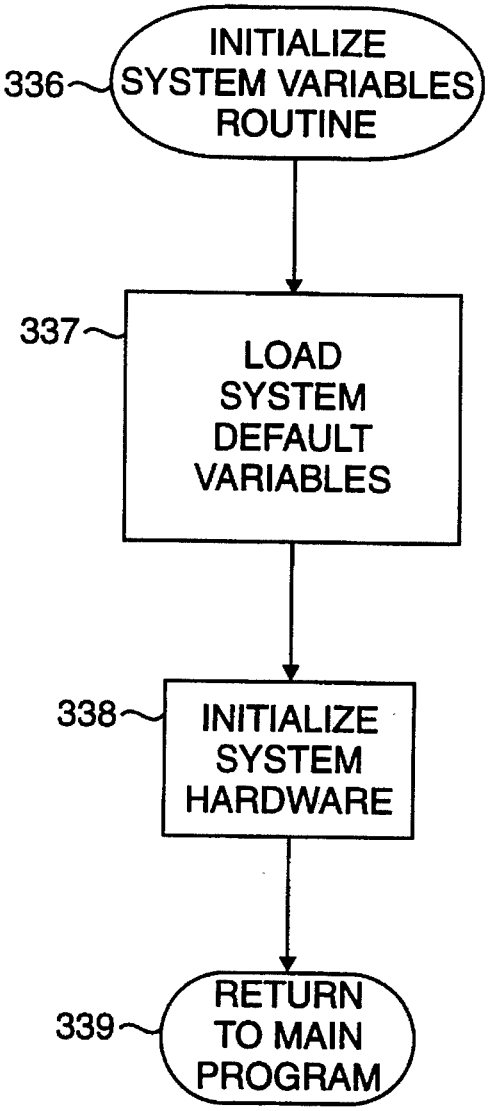
FIG. 19 is a flow chart of the initialize system variables routing of FIG. 17.

After completing the system diagnostics 305 and determining that the controller 200 has passed the diagnostics 334, the microprocessor 201 returns to the main program 300 to initialize the system variables within an initialize system variable routine 336. As shown in FIG. 19, the system default variables are loaded 337, such as the default patient height and weight of 5'6" and 150 pounds, and the system hardware 338 is initialized closing any open valves 230, 231 and turning off the alarm 202, and also checking all switches.

After initializing the system, the microprocessor 201 initiates the Float mode of operation (discussed below) and enters a continuous loop within the program 300, as shown in FIG. 17, in which microprocessor 201 continuously monitors the system to see what mode of operation the system is in or what key pad 203 choices the operator has made. If the microprocessor 201 determines the system mode of operation is currently leveling the patient or that leveling is required by a subroutine 339, the microprocessor 201 enters or remains within the leveling subroutine 340 (which will be discussed below in regard to patient rotation). The leveling subroutine 340 preferably cannot be exited until it is completed, unless the operator desires to put the controller 200 in the CPR mode of operation to administer CPR.

If, while monitoring the system, the microprocessor 201 determines that the system is in Float or Firm mode 358, it will check to see whether the patient default values of height and weight (noted above) are in use 359. If the default values are in use, the microprocessor 201 will display an "Enter Weight, Height" message 361, thus reminding the operator to customize the system for the current patient. If the patient height and weight have already been entered, the microprocessor 201 will display 360 the actual pressures in each Zone I–VI.

The microprocessor 201 also continuously reads 362, within the program 300, the key pad 203 to determine whether a valid key stroke has been made 363. If a valid key stroke has been made, a short audio beep is sounded (for approximately 20 ms). If an invalid key stroke has been made, a longer audio beep is sounded (for approximately 120 ms) alerting the operator that the key stroke was invalid.

The key pad 203 comprises keys to lock the key pad, to shut the alarm 202 off if it has been activated, to place the system in Float, Firm, or CPR mode of operation, and to access other menus. If, while monitoring the key pad 203, the microprocessor 201 determines that one of these keys has been chosen 364, 366, 368, 370, 372, and 374, the microprocessor 201 will enter the corresponding subroutine 365, 367, 369, 371, 373, and 375.

The keypad lock subroutine 365, when entered, preferably prevents the key pad 203 from accepting any more commands. The alarm subroutine 367 allows the operator to silence the alarm 202 if it has been triggered. The alarm 202 is preferably triggered in such instances as when the system enters the CPR mode, the system is unable to attain a desired pressure, or there is a control system failure.

In the Float subroutine 369, the microprocessor 201 sends a desired pressure profile to a pressure control routine (not shown). The pressure profile comprises the desired pressures for each of the respective Zones I–VI of cells 20 and 40. After a patient's height and weight have been entered, the microprocessor 201 calculates the pressures desired per cell Zone I–VI which may effectively diminish the interface pressure on a patient's skin over a large portion of the patient's body. The height and weight of a patient modifies the weight/mass distribution of the patient's body over the cells 20 and 40. Thus, the pressure profile is patient-specific. Other embodiments may compensate for the various body types and adjust the desired pressures based on whether a patient is a male or female, or whether the patient is lean or corpulent.

Within the pressure control routine, the microprocessor 201 preferably maintains the pressures in each Zone I–VI to within 0.1 inch of water by opening and closing inlet and exhaust valves 230 and 231. The length of time that a valve 230 and 231 remains open is dependent on the difference between the desired and actual pressures and whether the actual pressure is lower or higher in relation to the desired pressure.

The actual pressure in each Zone I–VI is determined by using the pressure sensors 206 to preferably take twenty-five data samples at ten millisecond intervals and average them. The pressure sampling begins approximately three hundred milliseconds after all valves 230 and 231 are closed to diminish the effects of "fluid hammer" on the pressure sensor 206 readings.

In the Firm subroutine 371, the microprocessor 201 similarly sends a pressure profile to the pressure control routine. However, the pressure profile for the Firm mode of operation is not patient-specific. The Firm mode simply requires that each Zone I–VI be maintained at a pressure of ten inches of water.

The CPR subroutine 373 is entered to administer CPR on the patient. Since it is desired to have a flat, firm surface to perform CPR on, the CPR subroutine 373 closes all inlet valves 230 and opens all exhaust valves 231 to aid in exhausting air from the cells 20 and 40. In addition, the microprocessor 201 disables all alarm functions after the initial sounding of the alarm 202. In the CPR mode of operation, the operator would also pull the CPR strap 170 to dislodge the plugs 176 from the CPR exhaust tubing 146 to rapidly exhaust air from the cells 20 and 40. The exhaust valves 231 remain open to ensure that the cells 20 and 40 remain uninflated until the operator chooses another mode of operation.

If the operator chooses to enter the menu subroutine 375, the operator will continue to have the key pad 203 options of entering the Float, Firm, and CPR mode of operation. Therefore, if, as the microprocessor 201 continues monitoring the system, the microprocessor determines that the Float, Firm, or CPR keys have been chosen 383, 385, and 388, the microprocessor 201 will enter the corresponding subroutines 384 (369), 386 (371), 389 (373).

Figures 1, 21:
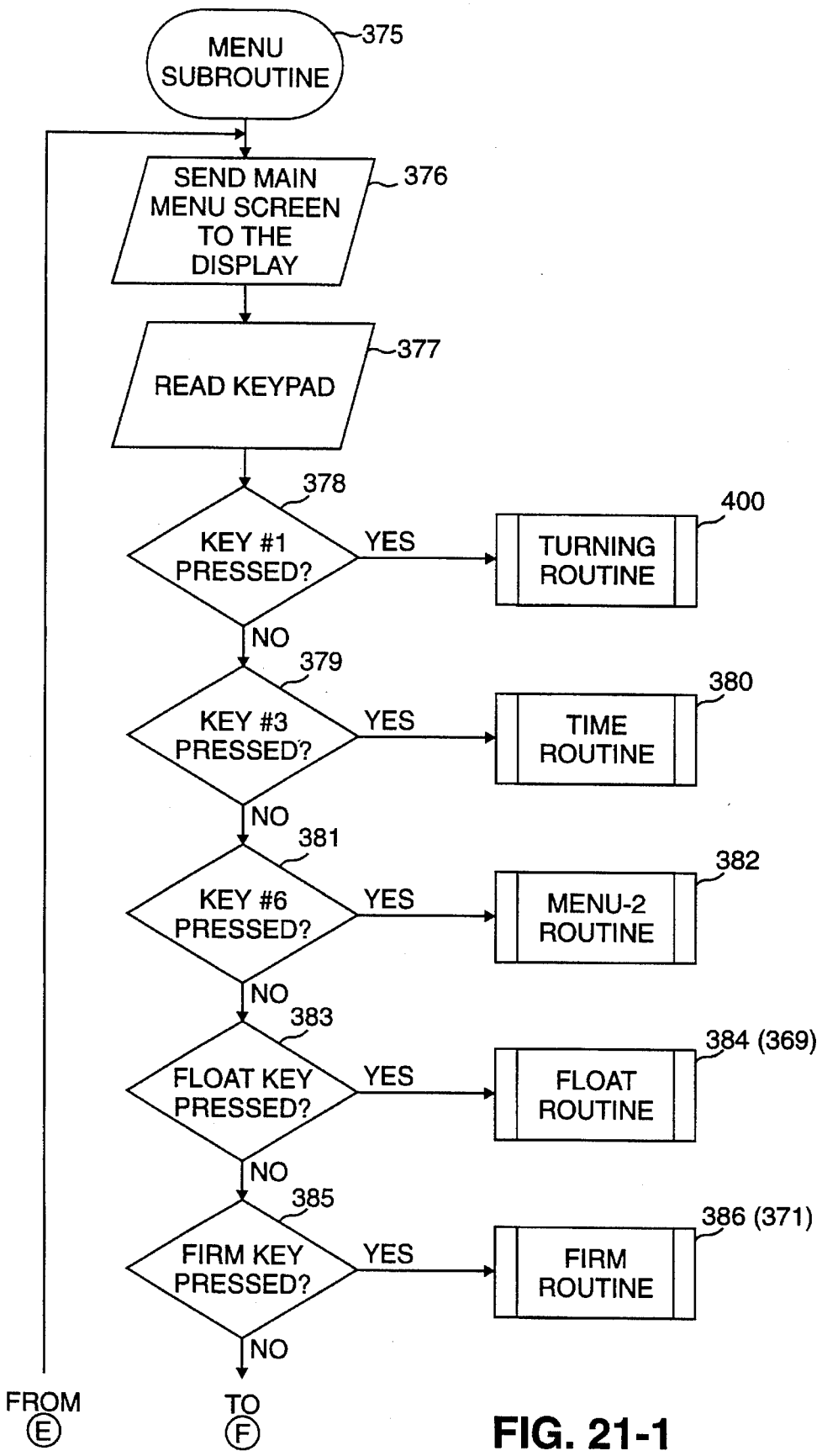
FIG. 21 is a flow chart of the menu subroutine of FIG. 17.
Figures 2, 21:
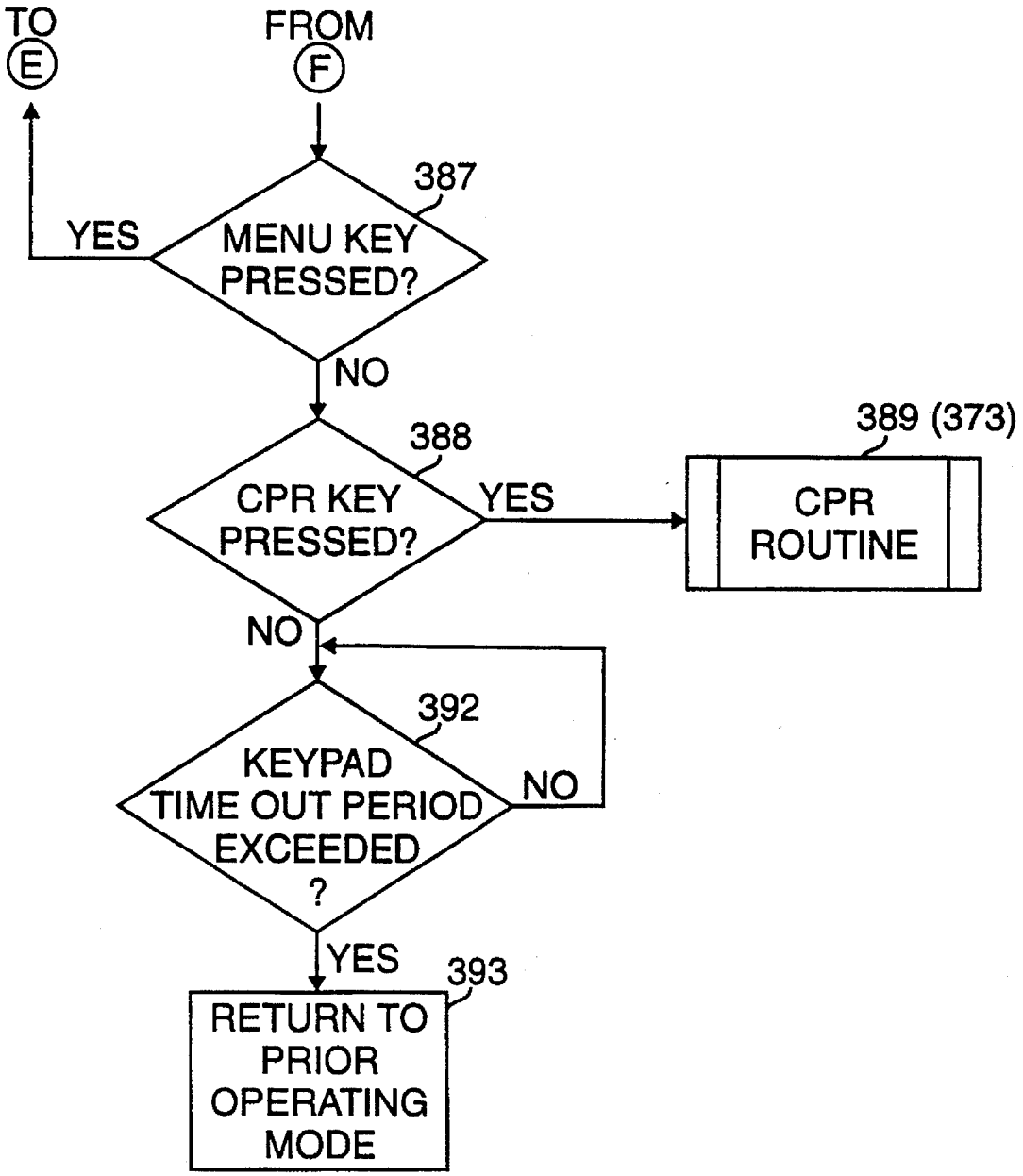

However, the operator will have an additional three key options presented 376 in the menu subroutine 375. As shown in FIG. 21, these key options comprise a key for entering a turning mode of operation, for determining the time for which the patient has been on the system, and for setting up the patient height, weight, and rotation parameters. If while monitoring the system, i.e., reading the key pad 377, the microprocessor 201 determines that one of these key options has been chosen 378, 379, and 381, the corresponding subroutine 400, 380, and 382 will be entered into.

While the microprocessor 201 is within the Menu-2 subroutine 382, the operator is able to enter a patient's height and weight for calculating the desired pressure profile for the patient. In addition, the operator is able to manually adjust the pressure profile and vary the pressures within the different Zones I–VI. However, the microprocessor 201, upon entering the turning mode of operation, will return to the profile calculated to correspond to the patient's specific height and weight.

In addition to the patient and profile parameters, the operator is also able to enter and adjust the rotation parameters for the turning mode of operation while the microprocessor 201 is in the Menu-2 subroutine. The rotation parameters comprise selecting a low, medium, or high angle of rotation in either a left or right direction of rotation, and the time a patient is to remain rotated at a specific angle, or in the center position. The nominal angles of rotation are 15 (low), 30 (medium) and 45 (high) degrees.

The microprocessor 201, while in the menu subroutine 375, also monitors whether the menu key has been pressed 387 or whether a predetermined period of time has been exceeded 392 without any key pad 203 input. If the menu key has been pressed, the microprocessor 201 returns to the beginning of the menu subroutine 375 and displays the initial options. If the time has been exceeded, the system returns to the prior mode of operation 393.

Figure 22:
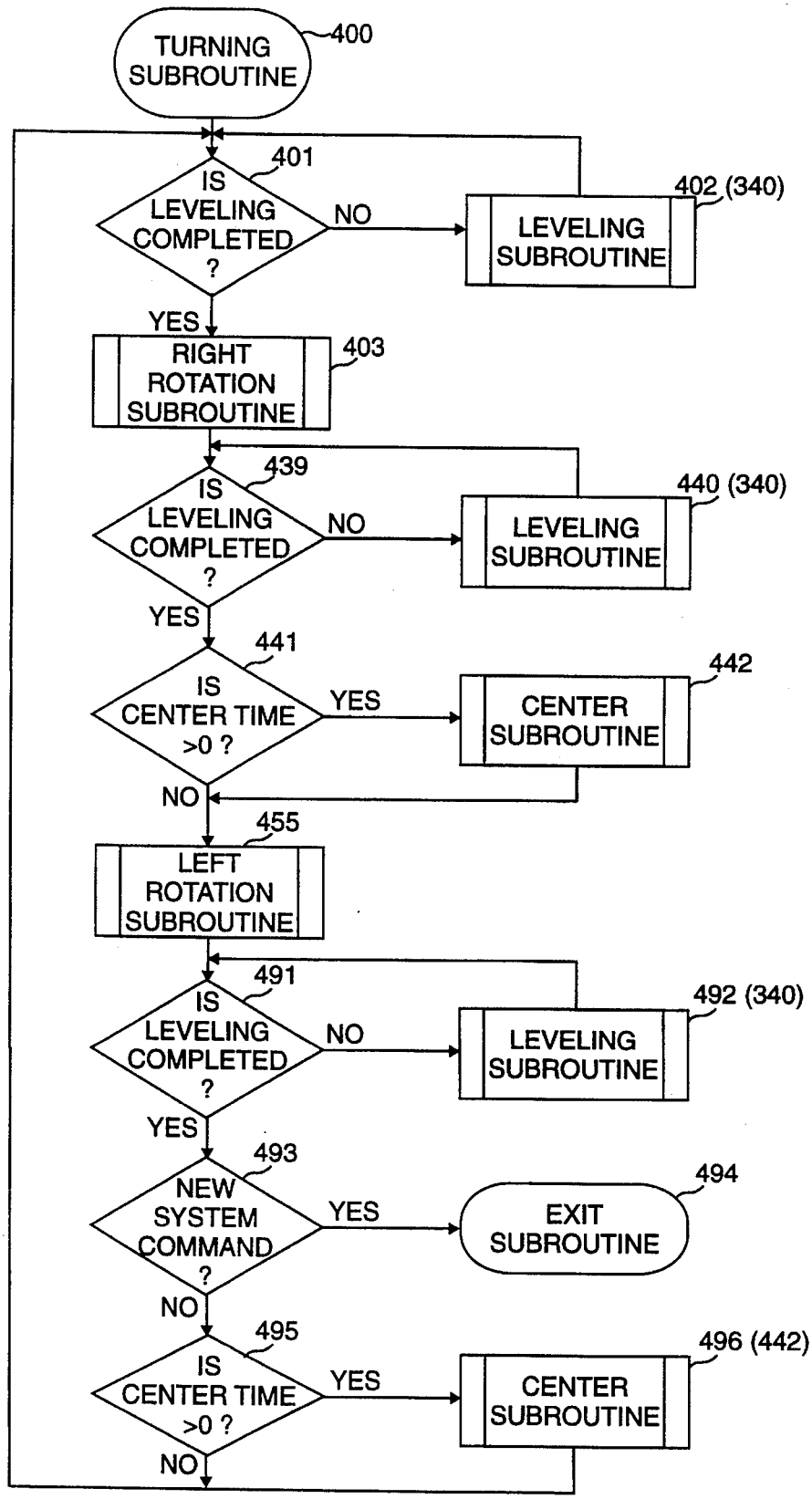
FIG. 22 is a flow chart of the turning subroutine of FIG. 21.

In the turning subroutine 400, as shown in FIG. 22, the microprocessor 201 first determines whether the patient is level 401. If the patient is not level, the microprocessor 201 enters or remains within the leveling subroutine 402(340). However, if the patient is level, the microprocessor 201 enters the right rotation subroutine 403 and rotates the patient to the right. Upon completing the right rotation subroutine 403, the microprocessor 201 enters the leveling subroutine 440(340) and continues to monitor whether the patient is level 439. When the patient is level, the microprocessor 201 enters the center subroutine 442 if the operator has chosen a time greater than zero for the patient to remain in the centered position 441. If the time is not greater than zero, the microprocessor 201 immediately enters the left rotation subroutine 455 to rotate the patient to the left. Upon completing the left rotation subroutine 445, the microprocessor again enters the leveling subroutine 492(340) and continues to monitor whether the patient is level 491. As above, after the patient is level, the microprocessor 201 will enter the center subroutine 496(442) if the time is greater than zero 495 or continue on to the right rotation subroutine 403 if the time is not greater than zero. These subroutines 340, 403, 442, and 455 are discussed in more detail below.

Figures 1, 23:
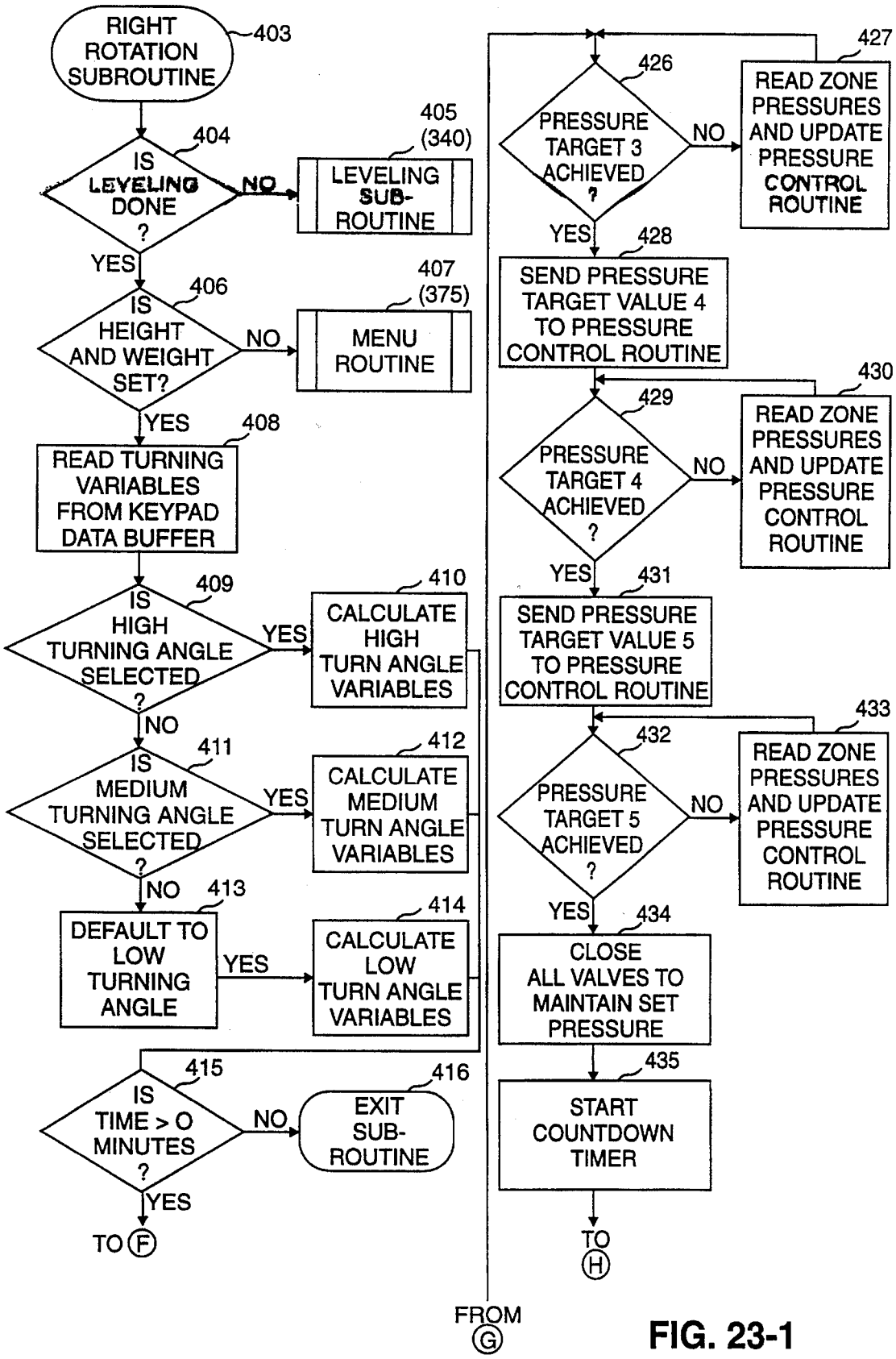
FIG. 23 is a flow chart of the right rotation subroutine of FIG. 22.
Figures 2, 23:
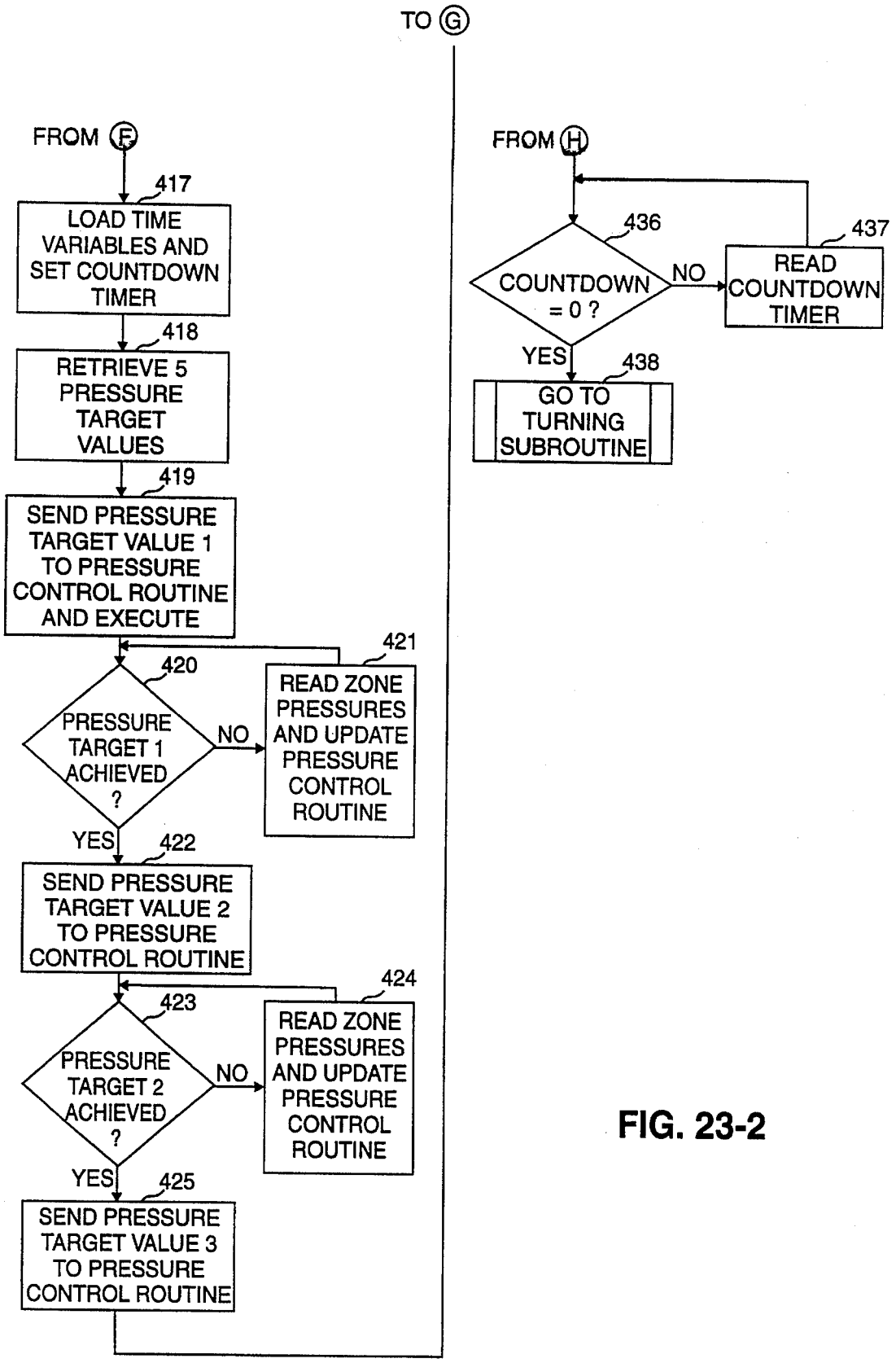

In the right rotation subroutine 403, as shown in FIG. 23, the microprocessor 201 first determines whether the patient is level before proceeding 404. If the patient is not level, the microprocessor 201 enters, or remains within, the leveling subroutine 405(340). Next, the microprocessor 201 determines whether the patient's height and weight have been entered 406. If the patient parameters have not been entered, the microprocessor 201 enters the menu subroutine 407(375) to allow the operator to access the menu-2 subroutine 382 to enter the patient's height and weight.

Figure 16B:
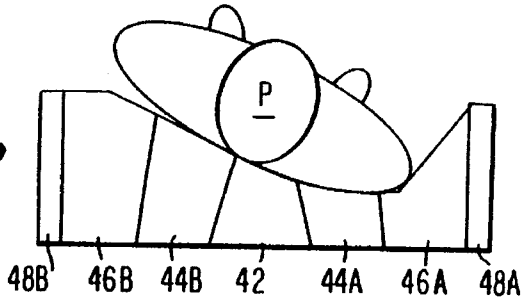
FIG. 16B is an end view of a patient rotated to a right turn angle on the turning cells the present invention.
Figure 16C:
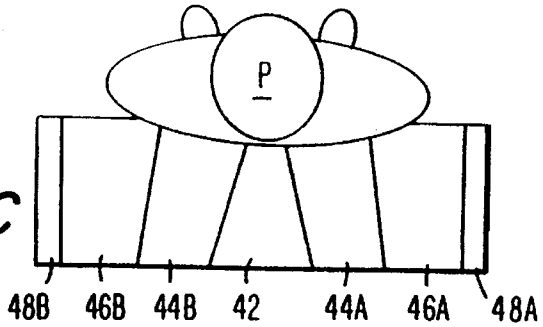
FIG. 16C is an end view of a patient in a center and level position on the turning cells of the present invention.
Figure 16D:
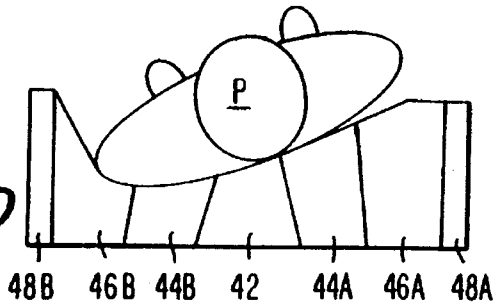
FIG. 16D is an end view of a patient rotated to a left turn angle on the turning cells of the present invention.
Figure 16A:
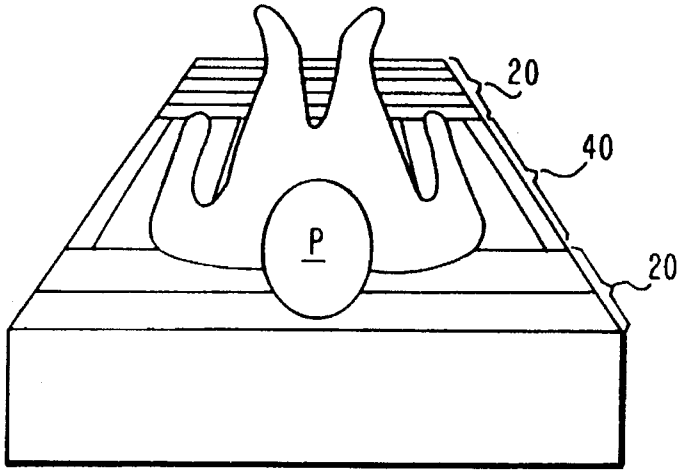
FIG. 16A is a perspective view of a patient in the center and level position on top of air cells of the present invention.

With the patient parameters entered, the microprocessor 201 reads the rotation parameters from the key pad 203 data buffer. The microprocessor 201 then calculates 410, 412, and 414, preferably, a set of five target pressures for each Zone I–VI that correspond to a high, medium, or low turning angle, depending on whether the operator has chosen a high, medium, or low angle 409, 411, and 413. The five target pressures tend to gradually rotate the patient in five steps to the desired turn angle. Thus, a smooth transition for the patient from a level position, as seen in FIGS. 16A and 16C, to an angled position, as seen in FIGS. 16B and 16D, is achieved. This method of rotation serves to increase the accuracy in which the turning angle is achieved, and also serves to diminish the potential for motion sickness in the patient. The following is an example of the five target pressures in each zone for a high turn angle:

TABLE I

| Step | Zone I | Zone II | Zone III | Zone IV | Zone V | Zone VI |
|---|---|---|---|---|---|---|
| Start | 6.0" | 6.0" | 6.0" | 6.0" | 6.0" | 1.0" |
| 1 | 4.9" | 5.0" | 5.8" | 6.4" | 6.8" | 1.0" |
| 2 | 3.8" | 4.0" | 5.6" | 6.8" | 7.6" | 1.0" |
| 3 | 2.7" | 3.0" | 5.4" | 7.2" | 8.4" | 1.0" |
| 4 | 1.6" | 2.0" | 5.2" | 7.6" | 9.2" | 1.0" |
| 5 | 0.5" | 1.0" | 5.0" | 8.0" | 10.0" | 1.0" |

The cell pressures in Zone VI, as shown in Table I, which corresponds to the foot/leg region, tend to be lower than the cell pressure in Zone VI during Float mode. This lower pressure adjusts and/or maintains a proper foot/leg angle relative to the patient's torso, thus tending to maintain proper spinal alignment during turning.

If the operator has input a time for which the patient is to remain rotated that is greater than zero 415, the microprocessor 201 will continue within the right rotation subroutine 403 and the patient will be turned. However, if the time is not greater than zero, the microprocessor 201 will exit the subroutine 416 and the patient will not be turned to the right.

Next, the microprocessor 201 sets the countdown timer to the above-referenced time 417 and the calculated pressure targets are retrieved 418. The first target pressure for each Zone I–VI is sent to the pressure control routine 419. As above, the pressure control return opens and closes valves 230, 231 to achieve the target pressures. The microprocessor 201 continues to monitor whether the first target pressures are achieved 420 and update the pressure control routine until the first target pressures are achieved 421. The program continues to duplicate these steps 419, 420, and 421 to achieve the remaining second, third, fourth and fifth target pressures 422, 423, 424, 425, 426, 427, 428, 429, 430, 431, 432, 433.

The program preferably adjusts the tolerances within which the target pressure must be achieve to increase the speed and efficiency by which the program steps through the five desired target pressures. The tolerances preferably vary depending on the desired target pressure. For example, for target pressures between 0.0 inches and 2.0 inches of water, the accuracy by which the pressure shall be achieved is +0.2 inches of water; for target pressures between 2.0 inches and 5.0 inches of water, the accuracy by which the pressure shall be achieved is +0.3 inches of water; and, for target pressures between 5.0 inches and 10.0 inches of water, the accuracy by which the pressure shall be achieved is ±0.5 inches of water.

As shown in FIG. 16B, while the microprocessor 201 is within the right rotation subroutine 403, the patient tends to rotate to the right about the fulcrum cell 42 on to the "low pressure" cells, which comprise the inside and outside right cells 44A and 46A in this instance. The inside and outside left cells 44B and 46B achieve an elevated pressure, thus causing an angle to be formed across the tops of the cells.

Once the fifth set of target pressures is achieved, the microprocessor 201 closes all valves 230 and 231 to maintain the inflation within the cells 20 and 40 at the level achieved at the fifth set of target pressures and, thus, essentially maintain the turn angle achieved. By closing the valves 230 and 231, the patient will not "bottom out" on the base 150. If the valves 230 and 231 did not close, the pressure control routine would continue to cause the controller 200 to open the exhaust valves 231 to maintain the pressure in the cells 44A and 46A as the weight of the patient's body causes the volume of the inside and outside right cells 44A and 46A to reduce, and the pressure within these cells 44A and 46A to rise.

Upon closing the valves 434, the microprocessor 201 starts and monitors the countdown timer 435 and 437. When the time reaches zero 436, the microprocessor 201 returns to the turning routine 400. Within the turning routine 400, the microprocessor 201 determines that the patient is not level 439 and thus enters the leveling subroutine 440(340) to level the patient.

The leveling subroutine 340 is very important to ensure proper turning of the patient. The leveling subroutine 340 diminishes the potential for a patient to travel or drift away from the center of the bed or the fulcrum cell 42, and serves to maintain the patient in a proper position to be turned.

Figures 1, 24:
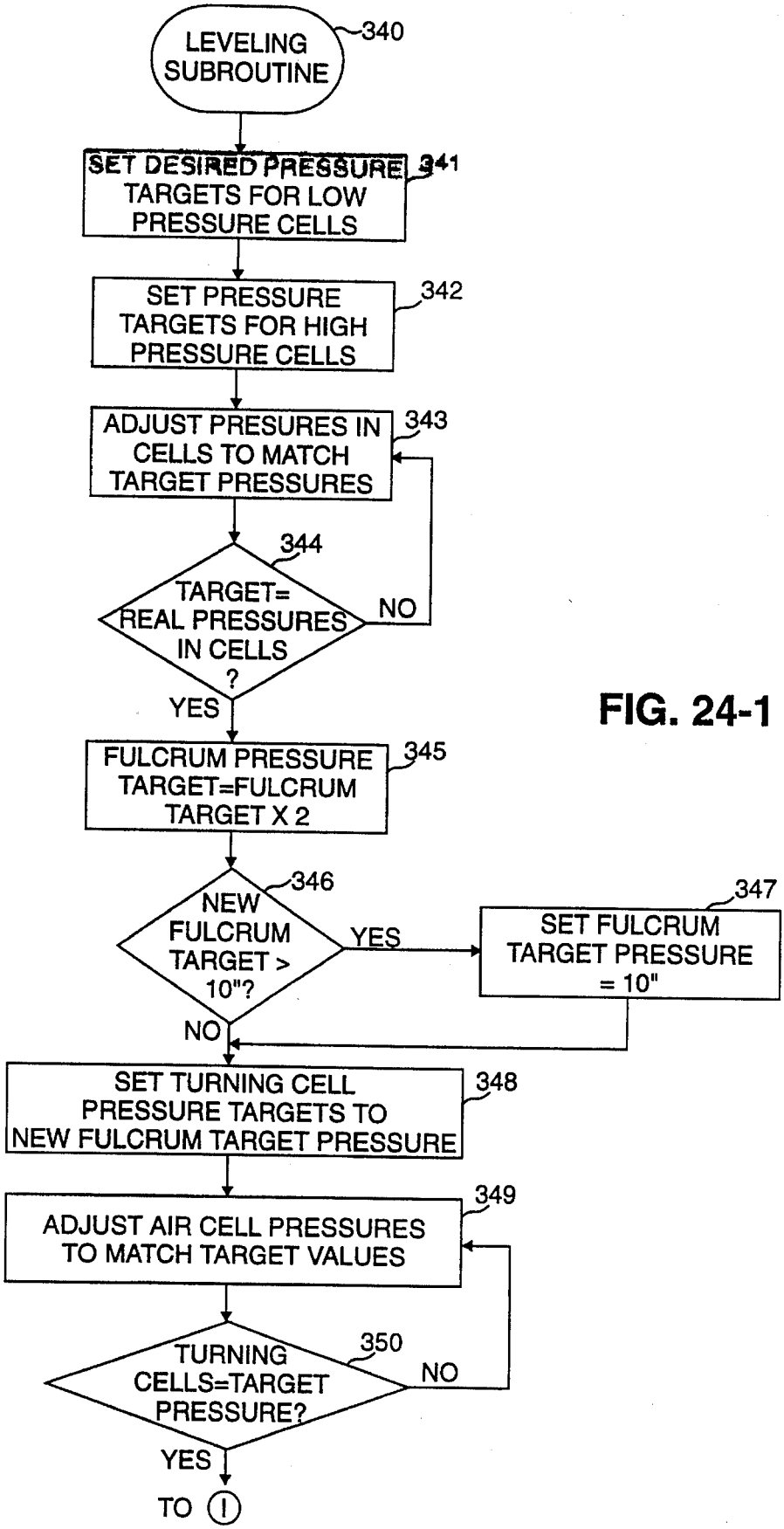
FIG. 24 is a flow chart of the leveling subroutine of FIGS. 17, 22, 23, 25 and 26.
Figures 2, 24:
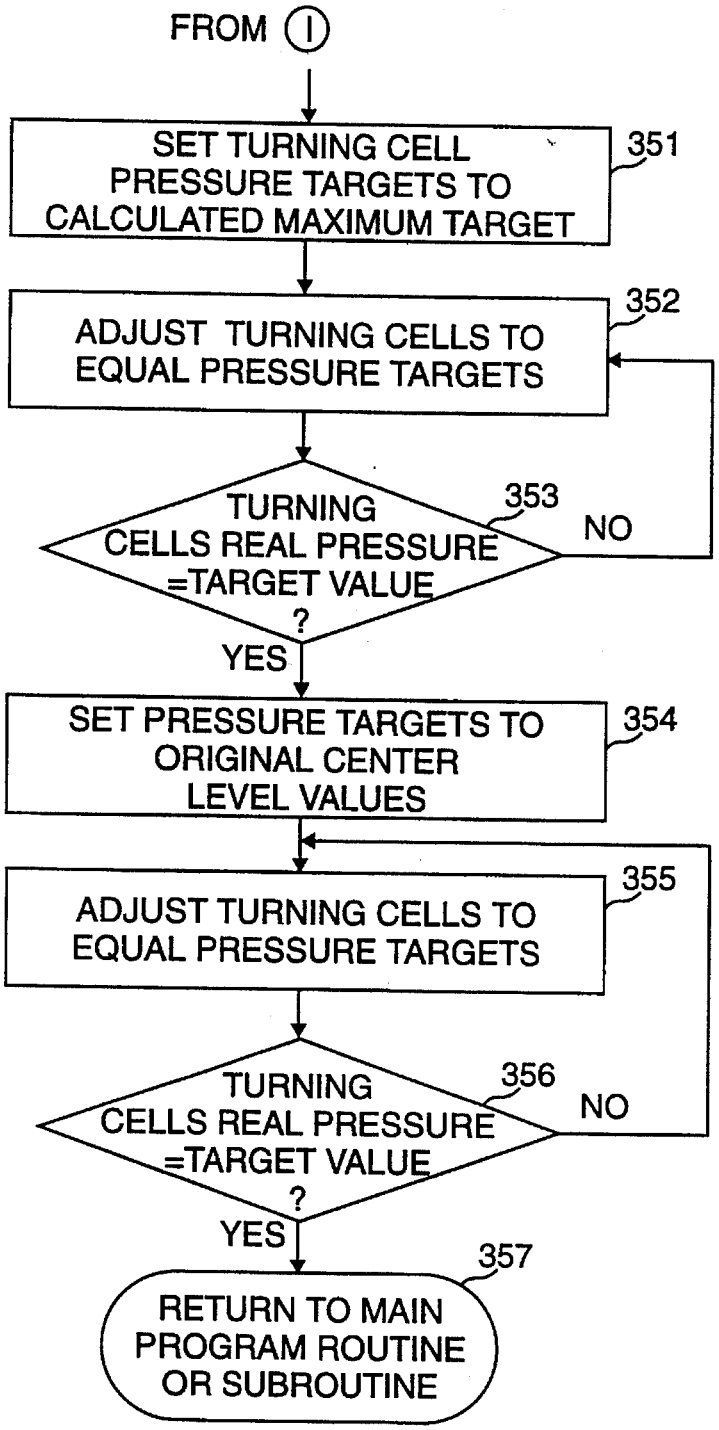

In the leveling subroutine 340, as shown in FIG. 24, the microprocessor 201 first sets the desired leveling target pressure for the low pressure cells, in this instance the inside and outside right cells 44A and 46A, to the actual pressure of the fulcrum cell 42 plus two inches of water pressure. Next, the microprocessor 201 sets the desired leveling target pressure for the high pressure cells, in this instance the inside and outside left cells 44B and 46B, to the actual fulcrum cell 42 pressure minus two inches of water pressure. The program then calculates six intermediate target pressures in relation to the actual pressures of the inside and outside cells 44A, 44B, 46A, and 46B and the desired leveling target pressures. The pressure in the cells 44A–B and 46A–B are adjusted to the intermediate and leveling target pressures 343 and 344 in seven successive steps, which tends to provide a smooth transition for the patient from a turned position, as seen in FIG. 16B, to an overcompensated center position (not shown).

When the desired leveling target pressures are achieved, the microprocessor 21 then sets the fulcrum cell 42 to an elevated target pressure which is twice the fulcrum cell's 42 actual pressure 345. However, if this target pressure is greater than ten inches of water pressure, the elevated fulcrum target pressure is set to ten inches of water pressure 346 and 347. The microprocessor 201 then sets the turning cells 40 target pressures to the elevated fulcrum target pressure 348. The pressure in the turning cells 40 are then adjusted to achieve the elevated fulcrum target pressure 349 and 350.

After reaching the elevated fulcrum target pressure, the microprocessor 201 sets the turning cells' 40 pressures to a maximum target pressure 351. The maximum target pressure is based on a patient's height and weight, and is calculated to make sure all the turning cells 40 are fully inflated. The turning cells 40 are then adjusted to achieve the maximum target pressure 352 and 353.

After reaching the maximum target pressure, the microprocessor 201 sets the turning cells' 40 pressures to the original center level pressures 354. The center level pressures are equivalent to the pressure profile values determined for the Float mode of operation. The turning cells 40 are then adjusted to achieve the center level pressures 355 and 356. When these pressures are reached 356, the microprocessor 201 returns to either the main program routine 300 or the turning subroutine 400.

Upon exiting the leveling subroutine 340 and re-entering the turning routine 400, the microprocessor 201 determines whether the operator selected a time greater than zero for the patient to remain in a center position 441. If the time is greater than zero, the microprocessor 201 enters the center subroutine 442.

Figure 25:
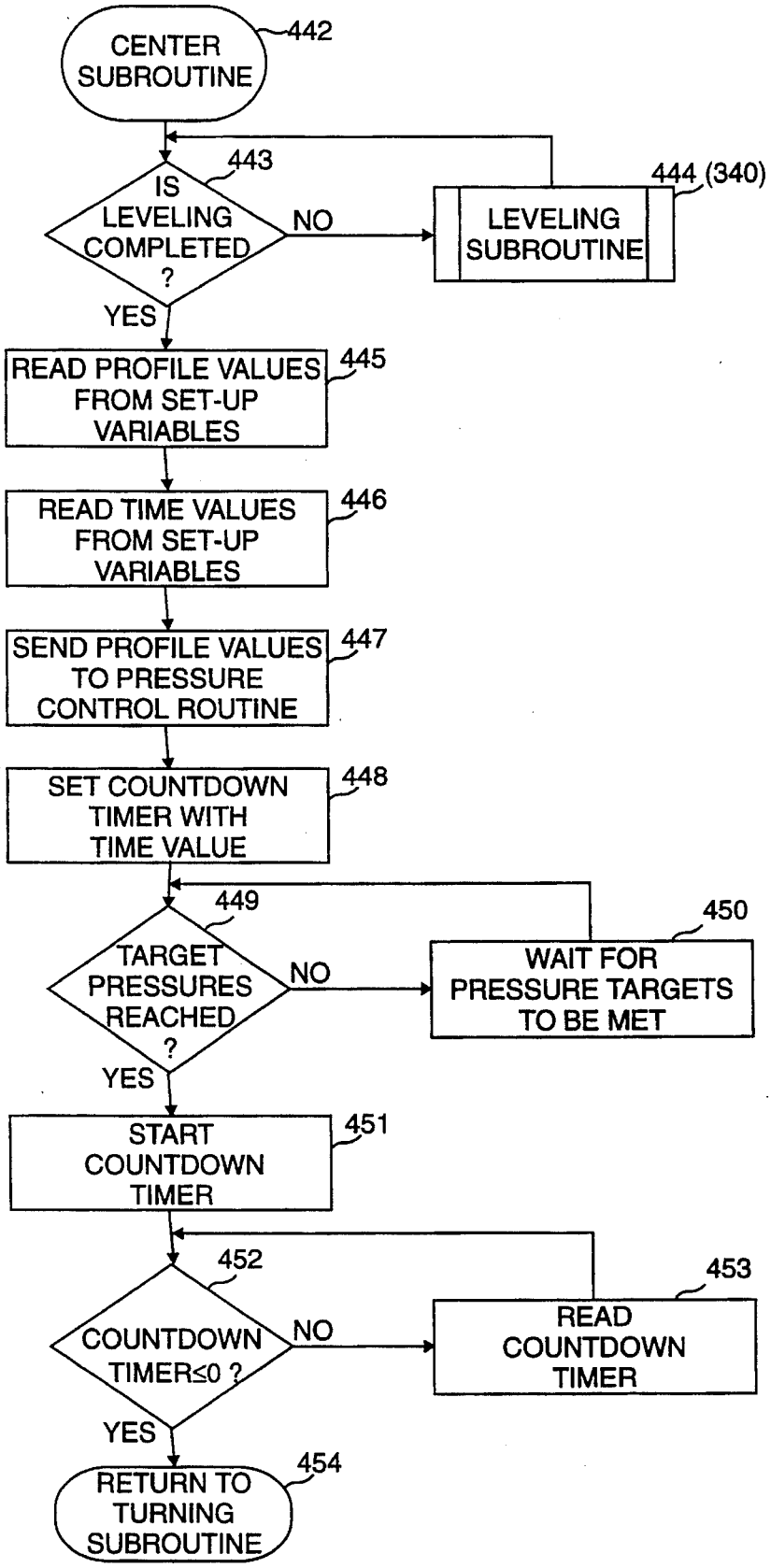
FIG. 25 is a flow chart of the center subroutine of FIG. 22.

In the center subroutine 442, as shown in FIG. 25, the microprocessor 201 first determines if the patient is level 443 and levels the patient if need be 444(340). Next, the microprocessor 201 reads from memory the pressure profile corresponding to the patient parameters of height and weight 445, and the time input by the operator for the patient to remain in the center position 446. The pressure profile is then sent to the pressure control routine 447 and the countdown timer is set to the above-reference input time value 448.

Once the microprocessor 201 determines that the profile pressures are achieved 449 and 450, the countdown timer is started 451. The patient remains in the center level position, as shown in FIGS. 16A and 16C, until the timer expires. After determining that the countdown timer value is less than or equal to zero 452 and 453, the microprocessor 201 exits the center subroutine 454 and re-enters the turning routine 400 to enter the left rotation subroutine 455.

Figures 1, 26:
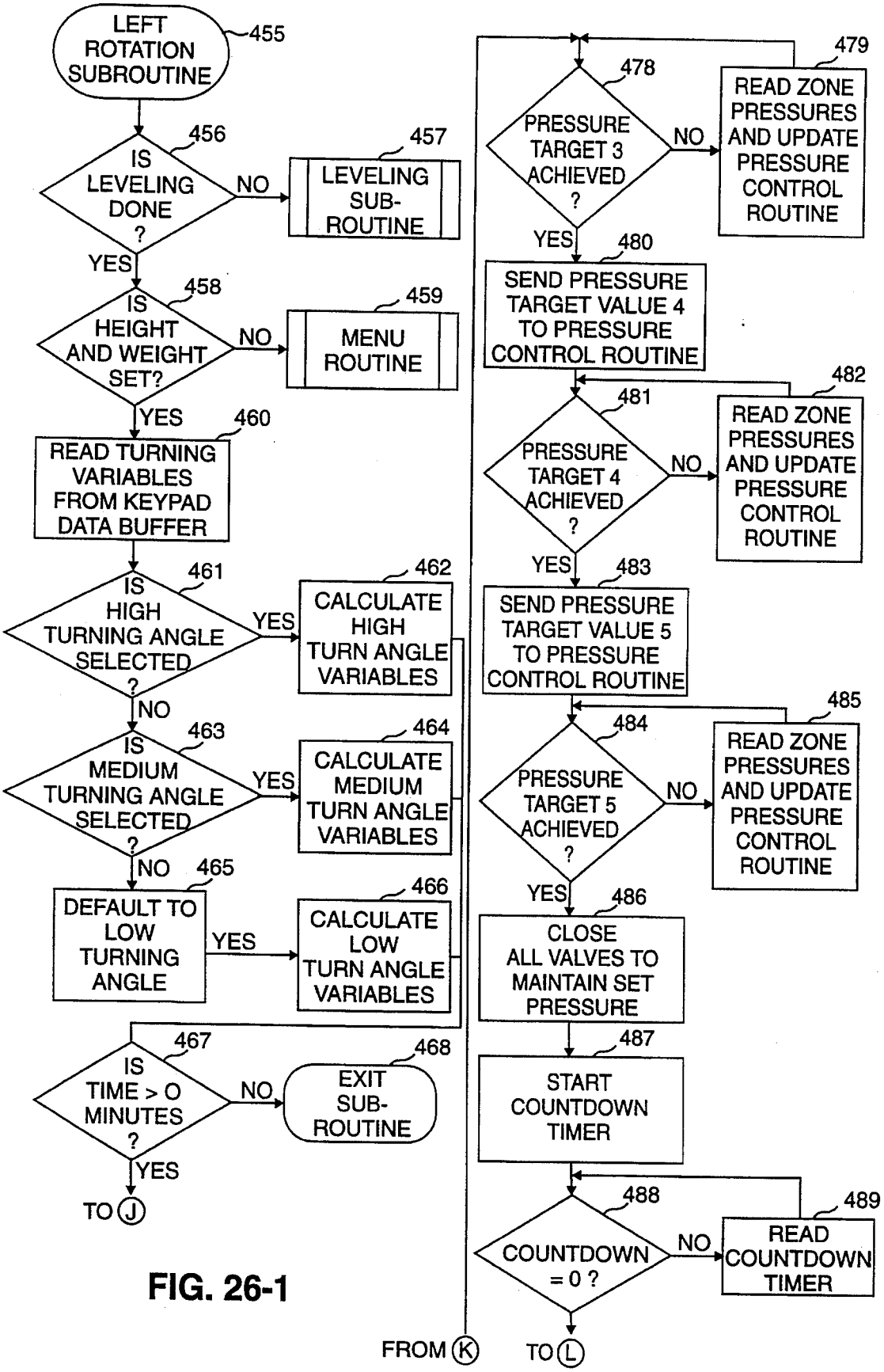
FIG. 26 is a flow chart of the left rotation subroutine of FIG. 22.
Figures 2, 26:
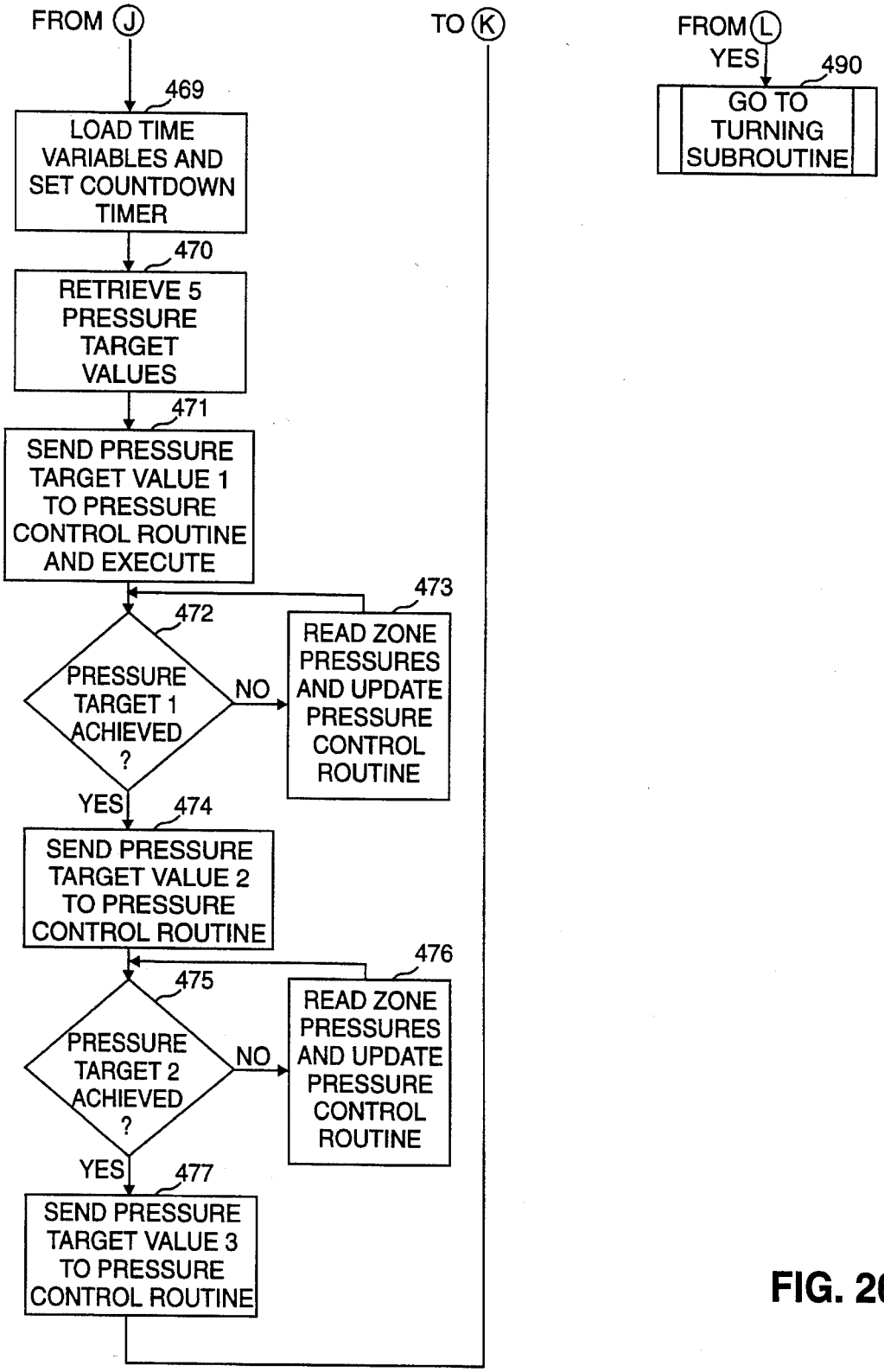

While in the left rotation subroutine 455, as shown in FIG. 26, the microprocessor 201 performs steps 456–490 to turn the patient to the left, as shown in FIG. 16D. In performing steps 456–490, the microprocessor 201 effectively performs the identical steps 404–438 performed in the right rotation subroutine 403. After completing the left rotation subroutine 455, the microprocessor 201 re-enters and continues within turning routine 400.

The operator, however, may choose to interrupt the turning mode of operation and return the patient to either the Float or Firm mode of operation, or enter the CPR mode of operation. The turning subroutine 400 can be interrupted and the system sent into the Float, Firm, or CPR mode of operation 493, 494 at any time. However, the microprocessor 201 will first go into or complete the leveling subroutine 340 before going into the Float or Firm modes of operation, but not before entering the CPR mode.

Thus, the turning air mattress device of the present invention provides many benefits over the prior art. While the above description contains many specificities, these should not be construed as limitations on the scope of the invention, but rather as an exemplification of one preferred embodiment thereof. Many other variations are possible.

Accordingly, the scope of the present invention should be determined not by the embodiments illustrated above, but by the appended claims and their legal equivalents.

What is claimed is:

1. A turning air mattress system comprising a base, a plurality of elongated air cells disposed on said base, said plurality of air cells including a combination of transverse and longitudinal air cells, the transverse air cells having generally catenary-shaped top and bottom surfaces and the longitudinal air cells being generally configured to comprise a fulcrum air cell and left and right side cells adjacent opposing sides of said fulcrum air cell, a control system including a plurality of pressure sensors, a plurality of inlet and exhaust valves, a microprocessor electrically communicating with said plurality of pressure sensors and said plurality of inlet and exhaust valves, a valve box having a high pressure plenum communicating with said plurality of inlet valves, an exhaust plenum communicating with said plurality of exhaust valves, and a plurality of manifold chambers interconnected to said plurality of air cells, to said plurality of inlet and exhaust valves, and to said plurality of pressure sensors, and a blower interconnected to said high pressure plenum.

2. The turning air mattress in claim 1, further comprising a plurality of air cell manifolds interconnected to said plurality of air cells and to said plurality of manifold chambers, said plurality of cell manifolds being disposed on said base.

3. The turning air mattress in claim 2, further comprising a CPR strap interconnected to the said plurality of cell manifolds.

4. The turning air mattress in claim 1, further comprising a cell liner encompassing said plurality of air cells.

5. The turning air mattress in claim 1, further comprising a top cover fastened to said base and covering said plurality of air cells.

6. The turning air mattress in claim 1, further comprising a fleece fittedly retained over said plurality of air cells.

7. The turning air mattress in claim 1, further comprising a top sheet fittedly retained over said plurality of air cells.

8. The turning air mattress in claim 6, further comprising a low air loss tube to supply aeration air to be distributed upwardly around a patient and wherein the top sheet further comprises air semi-permeable material.

9. A turning air mattress comprising a plurality of elongated air cells longitudinally and transversely disposed on a base, said plurality of air cells being grouped in a plurality of cell zones comprising, a first cell zone including a longitudinal fulcrum cell interconnected to a first plurality of interconnected transverse cells, said fulcrum cell having first and second sides and ends, said first plurality of transverse cells being adjacent said first end of said fulcrum cell, a second cell zone including a right side longitudinal air cell having first and second sides, said first side of said right side cell being adjacent said first side of said fulcrum cell, a third cell zone including a left side longitudinal air cell having first and second sides, said first side of said left side cell being adjacent said second side of said fulcrum cell, a fourth cell zone including a second plurality of interconnected transverse cells, said second plurality of transverse cells being adjacent said second end of said fulcrum cell.

10. The turning air mattress of claim 9, further comprising a fifth cell zone including an outside right longitudinal air cell interconnected to a left border longitudinal air cell, said outside right cell having first and second sides, said first side of said outside right cell being adjacent said second side of said right side cell, and a sixth cell zone including an outside left longitudinal air cell interconnected to a right border longitudinal air cell, said outside left cell having first and second sides, said first side of said outside left cell being adjacent said second side of said left side cell, said second side of said outside left cell being adjacent said left border cell, said right border cell being adjacent said second side of said outside right cell.

11. An elongated air cell comprising a top wall, a bottom wall, opposing end walls attached to said top wall and said bottom wall, opposing side walls attached to said top wall, said bottom wall, and said opposing end walls, and a dart in each of said opposing side walls, said dart causing said air cell to have a substantially catenary-like shape along said top wall and said bottom wall.

12. The air cell of claim 11, further comprising an interior wall attached to said opposing side walls, said interior wall having apertures therethrough, and an air connector attached to said bottom wall.

13. An elongated air cell comprising an upper main chamber, a lower main chamber connected to said upper main chamber, a first upper chamber connected to and angularly extending upwardly and outwardly from said upper main chamber, a second upper chamber connected to and angularly extending upwardly and outwardly from said upper main chamber, and angularly extending away from said first upper chamber, and first and second lateral chambers connected to and laterally extending from said upper and lower main chambers.

14. An elongated air cell comprising a top wall, a bottom wall, opposing side walls inwardly and upwardly extending from said bottom wall to said top wall, said opposing side walls being attached to said top and bottom walls, opposing end walls attached to said top, bottom and opposing end walls, and at least two opposing internal walls attached to said side walls forming at least three chambers within said air cell, said opposing internal walls being spaced apart from one another.

15. The air cell in claim 14, wherein said internal walls are equidistant from a midpoint between the top and bottom walls.

16. The air cell in claim 14 wherein said top walls, said bottom walls, and said side walls form a substantially truncated triangular cross-section.

17. A turning air mattress comprising a plurality of elongated air cells longitudinally disposed on a base comprising, a fulcrum cell having a pair of upwardly and inwardly sloping side walls and opposing top and bottom walls, and first and second side cells located adjacent and on opposing sides of said fulcrum cell and having a plurality of chambers substantially forming opposing top and bottom walls and a first at least one sloping side wall, with said first at least one sloping side wall of said first and second side cells being adjacent said fulcrum cell and having a slope substantially equal to the slope of said sloping side walls of said fulcrum cell.

18. The turning air mattress of claim 17, wherein said first and second side cells further comprises a second at least one sloping side wall, and further comprising first and second outside cells located adjacent said first and second side cells, respectively, and having a plurality of chambers substantially forming opposing top and bottom walls and a third at least one sloping side wall, with said third at least one sloping side wall of said first and second outside cells being adjacent said second at least one sloping side wall of said first and second side cells, respectively, and having a slope substantially equal to the slope of said second at least one sloping side wall of said first and second side cells, and first and second border cells located adjacent said first and second outside cells, respectively, and having opposing top, bottom, and side walls.

19. A method of turning a patient on an air mattress, said method comprising the steps of providing an air mattress including a plurality of elongated longitudinally disposed air cells comprising at least a fulcrum cell and right and left cells adjacent opposing sides of said fulcrum cell, calculating a center pressure profile comprising a center pressure for each of said plurality of air cells, choosing a patient turn angle, calculating a plurality of target pressures for each of said plurality of air cells relative to said center pressure profile and said patient turn angle, and adjusting the pressure in each of said plurality of air cells until each of said plurality of target pressures for each of said plurality of air cells is successively achieved, thereby rotating the patient about the fulcrum cell.

20. The method of claim 19, further comprising the step of adjusting a tolerance value for an accuracy by which said plurality of target pressures of each of said plurality of air cells are achieved.

21. The method of claim 19, wherein the first step further comprises providing a plurality of inlet and exhaust valves communicating with said plurality of air cells, and wherein the fifth step further comprises the steps of calculating a period of time necessary to keep ones of said plurality of inlet or exhaust valves open to achieve said plurality of target pressures in each of said plurality of said air cells, and opening ones of said plurality of inlet or exhaust valves for said period of time.

22. The method of claim 19 further comprising the step of determining whether the patient is level prior to turning the patient, and, if necessary, leveling the patient prior to turning.

23. A method of leveling a turned patient on an air mattress, said method comprising the steps of providing an air mattress including a plurality of elongated longitudinally disposed air cells comprising at least a fulcrum cell and right and left side cells adjacent opposing sides of said fulcrum cell, with each of said plurality air cells being inflated to pressures corresponding to a patient turn angle wherein said right side cell would be a low pressure cell and left side cell would be a high pressure cell if said patient turn angle is a right turn angle, setting a leveling target pressure for said low pressure cell to be equal to a pressure above the actual pressure in said fulcrum cell, a leveling target pressure for said high pressure cell to be equal to a pressure lower than the actual pressure in said fulcrum cell, and a leveling target pressure for said fulcrum cell to be substantially equal to the actual pressure of said fulcrum cell, adjusting the pressure in ones of said plurality of air cells successively through a plurality of intermediate pressures until said leveling target pressures of each of said plurality of air cells are achieved, setting the pressures in each of said plurality of air cells to be substantially equal to maximum target pressures, said maximum target pressures being pressures that ensure that each of said plurality of air cells are substantially fully inflated, adjusting the pressure in ones of said plurality of air cells until said maximum target pressures of each of said plurality of air cells are achieved, setting the pressures in each of said plurality of air cells to be equal to center profile pressures, and adjusting the pressure in ones of said plurality of air cells until said center pressures of each of said plurality of air cells are achieved.

24. A method of forming an air cell, said method comprising the steps of providing first, second, third, fourth, fifth, sixth, seventh, and eighth elongated sheets of flexible material having first and second opposing longitudinal edges and first and second opposing transverse edges, said first and second longitudinal edges of said first sheet being at least equal in length to said first and second longitudinal edges of said second, third, fourth, fifth, sixth, seventh, and eighth sheets, said first and second transverse edges of said second, third, fourth, fifth, sixth, seventh, and eighth sheets being shorter in length than said first and second transverse edges of said first sheet, attaching said first longitudinal edge of said first sheet to said second longitudinal edge of said first sheet, attaching said first and second longitudinal edges of said second and third sheets to said first sheet forming first and second chambers, respectively, therebetween, with the transverse length of said first sheet substantially retained between said first and second longitudinal edges of said second and third sheets being longer the transverse length of said second and third sheets, attaching said first longitudinal edge of said fourth, fifth, sixth, and seventh sheets to said first sheet and said second longitudinal edge of said fourth and sixth sheets, respectively, to said second longitudinal edge of said fifth and seventh sheets, respectively, and forming third and fourth chambers, respectively, therebetween, and attaching said first and second longitudinal edges of said eighth sheet, respectively, to said second longitudinal edges of said fourth and fifth sheets and said second longitudinal edges of said sixth and seventh sheets, respectively, and forming fifth and sixth opposing chambers.

25. A turning air mattress having a plurality of longitudinal air cells positioned under at least a portion of the torso of a patient, the air cells comprising:

a center fulcrum cell;

inside right and left cells positioned on either side of the fulcrum cell;

outside right and left cells positioned adjacent the inside right and left cells, respectively; and right and left border cells positioned adjacent the outside right and left cells, respectively, wherein, the outside right cell and the left border cell comprise a first air zone, the inside right cell comprises a second air zone, the center fulcrum cell comprises a third air zone, the inside left cell comprises a fourth air zone, and the outside left cell and the right border cell comprise a fifth air zone.

26. The turning air mattress of claim 25 further comprising at least one first transverse air cell for positioning under the head of a patient and at least one second transverse air cell for positioning under the foot/leg region of a patient.

27. The turning air mattress of claim 26 wherein the first transverse air cell is connected to the first air zone and the second transverse air cell comprises a sixth air zone.

* * * * *